US011412823B2

(12) United States Patent
Wright et al.

(10) Patent No.: US 11,412,823 B2
(45) **Date of Patent: *Aug. 16, 2022**

(54) PROTECTIVE OUTER CASE, ESPECIALLY FOR PORTABLE AUDIO DEVICE SYSTEMS

(71) Applicant: Speculative Product Design, LLC, San Mateo, CA (US)

(72) Inventors: Monica Elizabeth Wright, Falls Church, VA (US); Darrick Albert Del Moral, San Bruno, CA (US); Bryan Vo, San Francisco, CA (US); Christopher William Ledesma, Arcadia, CA (US); Bryan Hynecek, Redwood City, CA (US); Lauren O' Brien, Burlingame, CA (US)

(73) Assignee: Speculative Product Design, LLC, San Mateo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/109,789

(22) Filed: Dec. 2, 2020

(65) Prior Publication Data

US 2021/0085047 A1 Mar. 25, 2021

Related U.S. Application Data

(63) Continuation-in-part of application No. 16/522,408, filed on Jul. 25, 2019, now abandoned.

(Continued)

(51) Int. Cl.

| | |
|---|---|
| ***A45C 11/00*** | (2006.01) |
| ***A45C 13/02*** | (2006.01) |
| ***H04R 1/10*** | (2006.01) |

(52) U.S. Cl.

CPC ..... *A45C 11/00* (2013.01); *A45C 13/02* (2013.01); *A45C 2011/001* (2013.01);

(Continued)

(58) Field of Classification Search

CPC ..... A45F 5/00; A45C 11/00; A45C 2005/032; A45C 2005/035; A45C 13/02; B65D 1/00;

(Continued)

(56) References Cited

U.S. PATENT DOCUMENTS

| | | | |
|---|---|---|---|
| D386,611 | S | 11/1997 | Sheu |
| D426,950 | S | 6/2000 | Conway |

(Continued)

FOREIGN PATENT DOCUMENTS

| | | |
|---|---|---|
| CN | 208015951 U | 10/2018 |
| CN | 304877424 | 11/2018 |

(Continued)

OTHER PUBLICATIONS

Wright et al., U.S. Appl. No. 29/699,465, filed Jul. 25, 2019, titled "Outer Covering for Earbud Case".

(Continued)

*Primary Examiner* — Sunita Joshi

(74) *Attorney, Agent, or Firm* — Lerner, David, Littenberg, Krumholz & Mentlik, LLP

(57) ABSTRACT

An outer case for covering a handheld electronic device or handheld electronic device case includes a base, a lid, and a collar. The lid is pivotably attached to the base. The collar is attached to the base and is moveable away from the lid such that the lid rotates away from the base during movement of the collar away from the lid.

24 Claims, 23 Drawing Sheets

Related U.S. Application Data

(60) Provisional application No. 63/053,295, filed on Jul. 17, 2020.

(52) U.S. Cl.
CPC ..... *H04R 1/1016* (2013.01); *H04R 1/1025* (2013.01); *H04R 1/1041* (2013.01); *H04R 2420/07* (2013.01)

(58) Field of Classification Search
CPC ..... H04R 1/02; H04R 1/025; H04R 1/1041; H04R 1/1091
See application file for complete search history.

(56) References Cited

U.S. PATENT DOCUMENTS

| | | | | |
|---|---|---|---|---|
| D576,037 | S | | 9/2008 | Beam et al. |
| 7,673,745 | B2 | | 3/2010 | Sirichai et al. |
| 7,775,354 | B2 | | 8/2010 | Latchiford et al. |
| 8,755,852 | B2 | | 6/2014 | Hynecek et al. |
| D708,784 | S | | 7/2014 | Kim |
| 9,304,375 | B2 | | 4/2016 | Moon et al. |
| D775,818 | S | * | 1/2017 | Ingraham ..... D3/218 |
| 9,565,910 | B2 | | 2/2017 | Magness |
| 9,565,913 | B2 | | 2/2017 | Fathollahi |
| 9,686,878 | B2 | | 6/2017 | Choi et al. |
| D794,617 | S | | 8/2017 | Wright et al. |
| D794,618 | S | | 8/2017 | Wright et al. |
| 9,731,886 | B2 | | 8/2017 | Chang |
| 9,748,998 | B2 | | 8/2017 | Gronewoller et al. |
| 9,769,558 | B2 | | 9/2017 | Chandramohan et al. |
| 9,770,082 | B2 | | 9/2017 | Gronewoller et al. |
| D806,388 | S | | 1/2018 | Akana et al. |
| D818,268 | S | | 5/2018 | Akana et al. |
| 9,961,431 | B2 | | 5/2018 | McPeak et al. |
| 9,961,433 | B2 | | 5/2018 | Chawan et al. |
| 9,967,644 | B2 | | 5/2018 | Chawan et al. |
| 9,967,648 | B2 | | 5/2018 | Panecki et al. |
| 9,967,649 | B2 | | 5/2018 | Chandramohan et al. |
| 9,967,650 | B2 | | 5/2018 | Chawan et al. |
| 9,973,840 | B2 | | 5/2018 | Wagman et al. |
| 10,009,678 | B2 | | 6/2018 | Panecki et al. |
| 10,028,559 | B2 | | 7/2018 | Gronewoller et al. |
| 10,085,083 | B2 | | 9/2018 | Minoo et al. |
| 10,097,913 | B2 | | 10/2018 | Zorkendorfer et al. |
| D834,301 | S | | 11/2018 | Poissant |
| 10,144,551 | B2 | | 12/2018 | Ni |
| 10,182,282 | B2 | | 1/2019 | McPeak et al. |
| 10,212,506 | B2 | | 2/2019 | Panecki et al. |
| 10,219,598 | B2 | | 3/2019 | Gronewoller et al. |
| 10,225,637 | B2 | | 3/2019 | Panecki et al. |
| 10,232,986 | B2 | | 3/2019 | Bucholtz et al. |
| D849,401 | S | | 5/2019 | Akana et al. |
| 10,397,683 | B2 | | 8/2019 | LeBlanc et al. |
| D864,565 | S | | 10/2019 | Lee et al. |
| D868,453 | S | | 12/2019 | Lee et al. |
| D869,161 | S | | 12/2019 | Zhong |
| D872,094 | S | | 1/2020 | Wright et al. |
| D872,469 | S | | 1/2020 | Lee et al. |
| D872,723 | S | | 1/2020 | Lee et al. |
| D878,045 | S | | 3/2020 | Akana et al. |
| D878,754 | S | | 3/2020 | Lee et al. |
| D881,566 | S | | 4/2020 | Lee et al. |
| D882,259 | S | | 4/2020 | Liu |
| D887,402 | S | | 6/2020 | Chun |
| D888,408 | S | | 6/2020 | Lee et al. |
| D891,771 | S | | 8/2020 | Lee et al. |
| D891,774 | S | | 8/2020 | Yu |
| D892,497 | S | | 8/2020 | Wright et al. |
| D892,498 | S | | 8/2020 | Wright et al. |
| D893,166 | S | | 8/2020 | Lu |
| D898,664 | S | | 10/2020 | Bhutani |
| D900,471 | S | | 11/2020 | Jones |
| D901,177 | S | | 11/2020 | Wei |
| D901,382 | S | | 11/2020 | Zhang |
| D904,346 | S | | 12/2020 | Wright et al. |
| D907,009 | S | | 1/2021 | Akana et al. |
| D907,048 | S | * | 1/2021 | Wang ..... D14/440 |
| D907,049 | S | * | 1/2021 | Yu ..... D14/440 |
| D911,706 | S | | 3/2021 | Hyun |
| D913,292 | S | | 3/2021 | Brown |
| D914,604 | S | | 3/2021 | Wang |
| D922,070 | S | * | 6/2021 | Armstrong ..... D13/118 |
| D924,560 | S | | 7/2021 | Hyun |
| D924,565 | S | | 7/2021 | Gould |
| D930,361 | S | | 9/2021 | Jacobs |
| 2006/0091222 | A1 | | 5/2006 | Leung et al. |
| 2007/0256946 | A1 | | 11/2007 | Godshaw et al. |
| 2008/0090622 | A1 | | 4/2008 | Kim et al. |
| 2011/0005648 | A1 | | 1/2011 | Sa |
| 2011/0017620 | A1 | | 1/2011 | Latchford et al. |
| 2014/0069825 | A1 | | 3/2014 | Macrina et al. |
| 2014/0376763 | A1 | | 12/2014 | Stevinson |
| 2015/0076187 | A1 | | 3/2015 | Cohen |
| 2016/0198823 | A1 | | 7/2016 | Bergreen et al. |
| 2017/0094381 | A1 | * | 3/2017 | LeBlanc ..... H04B 5/0037 |
| 2018/0191392 | A1 | | 7/2018 | Poon |
| 2019/0075899 | A1 | | 3/2019 | Hynecek et al. |
| 2019/0075900 | A1 | | 3/2019 | Hynecek et al. |
| 2019/0081299 | A1 | | 3/2019 | Chiang et al. |
| 2020/0100573 | A1 | | 4/2020 | Ekelund |
| 2021/0029424 | A1 | | 1/2021 | Wright et al. |
| 2021/0058687 | A1 | | 2/2021 | Liu |
| 2021/0085047 | A1 | | 3/2021 | Wright et al. |

FOREIGN PATENT DOCUMENTS

| | | | |
|---|---|---|---|
| CN | 208581338 | U | 3/2019 |
| CN | 208939608 | U | 6/2019 |
| CN | 305198691 | | 6/2019 |
| CN | 209234022 | U | 8/2019 |
| CN | 209547264 | U | 10/2019 |
| CN | 210783233 | U | 6/2020 |
| EP | 1847478 | A1 | 10/2007 |
| WO | 2017032668 | A1 | 3/2017 |

OTHER PUBLICATIONS

Wright et al., U.S. Appl. No. 29/711,009, filed Oct. 28, 2019, titled "Outer Covering for Earbud Case".

Wright et al., U.S. Appl. No. 29/743,050, filed Jul. 17, 2020, titled "Outer Covering for Earbud Case".

European Union Intellectual Property Office, Registered Community Design No. 007546460-0001, entitled "Outer Covering for Earbud Case", filed and registered Jan. 23, 2020, and published on Feb. 13, 2020.

European Union Intellectual Property Office, Registered Community Design No. 007546460-0002, entitled "Outer Covering for Earbud Case", filed and registered Jan. 23, 2020, and published on Feb. 13, 2020.

European Union Intellectual Property Office, Registered Community Design No. 007546460-0003, entitled "Outer Covering for Earbud Case", filed and registered Jan. 23, 2020, and published on Feb. 13, 2020.

European Union Intellectual Property Office, Registered Community Design No. 007843255-0001, entitled "Outer Covering for Earbud Case", filed and registered Apr. 28, 2020, and published on Jun. 12, 2020.

European Union Intellectual Property Office, Registered Community Design No. 007843255-0002, entitled "Outer Covering for Earbud Case", filed and registered Apr. 28, 2020, and published on Jun. 12, 2020.

European Union Intellectual Property Office, Registered Community Design No. 007843255-0003, entitled "Outer Covering for Earbud Case", filed and registered Apr. 28, 2020, and published on Jun. 12, 2020.

European Union Intellectual Property Office, Registered Community Design No. 008403919-0001, entitled "Outer Covering for Earbud Case," filed and registered Jan. 15, 2021, and published on Jan. 22, 2021.

(56) References Cited

OTHER PUBLICATIONS

European Union Intellectual Property Office, Registered Community Design No. 008403919-0002, entitled "Outer Covering for Earbud Case," filed and registered Jan. 15, 2021, and published on Jan. 22, 2021.
European Union Intellectual Property Office, Registered Community Design No. 008403919-0003, entitled "Outer Covering for Earbud Case," filed and registered Jan. 15, 2021, and published on Jan. 22, 2021.
European Union Intellectual Property Office, Registered Community Design No. 008403919-0004, entitled "Outer Covering for Earbud Case," filed and registered Jan. 15, 2021, and published on Jan. 22, 2021.
Wright et al., U.S. Appl. No. 17/379,417, filed Jul. 19, 2021, titled "Protective Outer Case Especially for Portable Audio Device Systems".
Del Moral et al., U.S. Appl. No. 29/800,487, filed Jul. 21, 2021, titled "Outer Covering for Earbud Case".
Speck Products Presidio Clear Airpods Case (Gen 1/2), first available Nov. 14, 2019, amazon.com [online], [site visited Oct. 1, 2021], Available at internet URL: https://www.amazon.com/Speck-Presidio-Ciear-Airpods-Case/dp/B081GB8H6M (Year: 2019).
European Search Report issued in Appln. No. 21186394.9 dated Dec. 15, 2021 (2 pages).
"Catalyst Waterproof Case for AirPods—Special Edition—Glow in the Dark", <URL:https://www.apple.com/shop/product/HMUU2ZM/A/catalyst-waterproof-case-for-airpods-special-edition-glow-in-the-dark?afid=p238%7CsLXTwavx4-dc_mtid_1870765e38482_pcrid_246387003753_pgrid_15434682490_&cid=aos-us-kwgo-pla-btb-catchall--slid——product-HMUU2ZM/A>, as published as of Jun. 27, 2019, 2 pages.
Ahastyle, "AhaStyle Upgrade AirPods Case Protedive Cover [front LED Visible] Silicone Compatible with Apple AirPods 2 & 1 (Black)", <URL:https://www.amazon.com/AhaStyle-Silicone-Protective-Keychain-AirPods/dp/8077187F2R>, as published as of Jun. 27, 2019, 1 page.
Airpods Case sold by Casemate at least as early as Aug. 17, 2019. [online], [retrieved on Jan. 24, 2020]. Retrieved from the internet <URL:<https://case-mate.com/blush-sheer-crystal-airpod-hookups>>.
Airpods Case sold by Casemate at least as early as Jul. 7, 2019. [online], [retrieved on Jan. 30, 2020]. Retrieved from the internet <URL:<https://case-mate.com/blush-sheer-crystal-airpod-hookups>>.
Ekelund, U.S. Appl. No. 29/685,199, filed Mar. 27, 2019, titled "Storage Boxes".
Fironst, "2019 Fironst Airpods Case Cover Silicon Fast Wireless Charging Ultra-Thin Soft Front LED Visible Skin Protector Compatible with Apple AirPods 2&1 (Glittery Blue)", <URL:https://www.amazon.com/Fironst-Silicone-Ultra-Thin-Protector-Compatible/dp/B07QC5M8T1?th=1>, as published as of Jun. 27, 2019, 1 page.
Keybudz, "PodSkinz AirPods Case Protective Silicone Cover and Skin Compatible with Apple AirPods 1 & AirPods 2 [Front LED Not Visible] (Cobalt Blue)", <URL:https://www.amazon.com/PodSkinz-Protective-Silicone-Compatible-Charging/dp/B076W7K7L7>, as published as of Jun. 27, 2019, 2 pages.
SeeHee, "Airpods 2 Silicone Case Cover Compatible Apple Airpods 281 [Front LED Visible] (Olive Green)", <URL: https://www.amazon com/Airpods-Silicone-Cover-Compatible-Visible/dp/B07RQXJ1HF>, as published as of Jun. 27, 2019, 2 pages.
"elago AirPods Waterproof Slicone Case", <URL:https://www.urbanoutfitters.com/shop/elago-airpods-waterproof-silicone-case?adpos=1o4&color=046&creative=251419017062&device=c&matchtype=&mrkgadid=3275592826&mrkgcl=671&networ k=g&product_id=49335706&size=ALL&utm_campaign=NB_PLA_-_GSC_-_LIA&utm_content=Apartment_Media&utm_medium=cpc&utm_source=google&utm_term=341178301611_product_type_apartment_product_type_media_product_type>, as published as of Jun. 27, 2019, 2 pages.
Damonlight, "DamonLight Premium Silicone Airpods Case with Carabiner[Front LED Visible][with no Hinge] Full Protective Cover Skin Compatible with Apple Airpods 1&2 (Yellow+Midnight Blue)", <URL:https://www.amazon.com/DamonLight-Silicone-Carabiner-Protective-Compatible/dp/B07MZNBJ4T/ref=asc_df_B07MZNBJ4T/? tag=hyprod-20&linkCode=dfD&hvadid=309821119663&hvpos=1 o1 &hvnetw=g&hvrand=54926670028846851 3&hvpon e=&hvptwo=&hvqmt=&hvdev=c&hvdvcmdl=&hvlocint=&hvlocphy=9058761&hvtargid=pla-663115168000&psc=1&tag= &ref=&adgrpid=62379238755&hvpone=&hvptwo=&hvadid=309821119663&hvpos=1 o1 &hvnetw=g&hvrand=54926670 0288468513&hvqmt-&hvdev-c&hvdvcmdl-&hvlocint-&hvlocphy-9058761 &hvtargid-pla-663115168000>, as published as of Jun. 27, 2019, 1 page.

* cited by examiner

PROTECTIVE OUTER CASE, ESPECIALLY FOR PORTABLE AUDIO DEVICE SYSTEMS

CROSS-REFERENCE TO RELATED APPLICATIONS

The present application is a continuation-in-part of U.S. patent application Ser. No. 16/522,408 filed Jul. 25, 2019, and claims the benefit of the filing date of U.S. Provisional Patent Application No. 63/053,295 filed Jul. 17, 2020, the disclosures of which are hereby incorporated herein by reference.

FIELD OF THE INVENTION

The present application relates generally to audio accessories, and in particular, to a protective case for audio device systems.

BACKGROUND OF THE INVENTION

Wireless earbuds, such as Airpods® by Apple, Inc., are used in conjunction with a charging case. These charging cases are rigid to prevent damage to the earbuds contained in them. Left exposed, the charging cases are susceptible to scratches and to damage from the environment.

Various coverings for the charging cases that house the earbuds have been developed to address these issues and thus offer significant benefits over the use of charging cases alone as an external covering for wireless earbuds. Soft-touch silicone has been a preferred material to provide cushioning when the earbud case, a frictional surface for a better grip on the case, and significant scratch resistance.

Although these coverings offer significant benefits over the use of charging cases alone as an external covering for wireless earbuds, such coverings also have significant limitations. The use of silicone to provide an external surface for these coverings creates a highly frictional surface on the coverings that makes them difficult to place in and to remove from user's pockets and other tight places. External hinges of certain cases or recesses in bases for accommodating rotations of lids attached to the bases of certain cases snag on clothing or other objects in the external environment which subjects the earbud system and casings to potential drops or other shocks and possible loss.

Cases on the market also have tended to open involuntarily when snagged on clothing or when dropped on a hard surface or otherwise impacted. Moreover, such cases have allowed dirt and lint to accumulate within the charging case and even the earbuds themselves.

Accordingly, more secure coverings with lower friction, less susceptibility to snags, and enhanced environmental protection are desirable.

SUMMARY OF THE INVENTION

In accordance with an aspect of the invention, an outer case for covering a handheld electronic device or handheld electronic device case may include a base, a lid, and a connecting portion. The base may include a first base layer which may be made of an elastomeric first material and a second base layer which may be attached to the first base layer and which may be made of a second material different from the first material. The lid may include a first lid layer which may be made of an elastomeric third material and a second lid layer which may be attached to the first lid layer and which may be made of a fourth material different from the third material. The connecting portion may be attached along a rear wall of the base and a rear wall of the lid. The rear wall of the base, the rear wall of the lid, and the connecting portion may be flush when the outer case is in a closed state with the lid covering an opening defined by the base. The connecting portion may suspend the lid when the outer case is in a fully open state with the lid spaced from the base.

In some arrangements, the second and the fourth materials may be rigid materials.

In some arrangements, the first base layer and the first lid layer may define an interior of the outer case, and the second base layer and the second lid layer may define an exterior of the outer case.

In some arrangements, the first material and the third material may be the same material, and the second material and the fourth material may be the same material.

In some arrangements, the connecting portion may be a hinge such that the lid rotates relative to the base via the connecting portion in a direction away from the base towards the fully the open state of the outer case.

In some arrangements, the lid may include a lid flange, and the base may include a base flange closer to an opening defined by the base in an open state of the outer case than the lid flange when the outer case is in the closed state.

In some arrangements, the outer case may further include a hook or loop. The hook or loop may extend from the base. The hook or loop may be integral with the first base layer such that the hook or loop and the first base layer may be inseparable without fracture of either one or both of the hook or loop and the first base layer. The hook or loop may extend from the first base layer through the second base layer.

In some arrangements, the base, the lid, and the connecting portion may be integral such that the base, the lid, and the connecting portion may be inseparable without fracture of any one or any combination of the base, the lid, and the connection portion.

In some arrangements, either one or both of the base and the lid may be made of co-molded or co-casted polymer layers.

In some arrangements, either one or both of the base and the lid may be made of a plurality of layers attached by an adhesive.

In some arrangements, the first material and the third material each may include at least one material selected from the group consisting of thermoplastic elastomers ("TPEs"), thermoplastic polyurethane ("TPU"), silicone, rubber, and any combinations of these materials.

In some arrangements, the second material and the fourth material each may include at least one material selected from the group consisting of hardened plastic materials, rigid or semi-rigid plastic materials, rigid rubber materials, polycarbonate materials, metals, alloys, para-aramid materials, wood, glass, mirror, quartz, and any combinations of these materials.

In some arrangements, an outer surface or outer surfaces of any one or any combination of the first base layer, the second base layer, the first lid layer, and the second lid layer may include an antimicrobial substance or treatment. In such arrangements, the antimicrobial substance or treatment may be selected from the group consisting of silver and silver alloys, copper and copper alloys, organosilanes, quaternary ammonium compounds, chlorhexidine, chlorhexidine incorporated hydroxyapatite materials, chlorhexidine-containing polymers, and antibiotics.

In some arrangements, the outer case may conform to and may be configured for covering a case, which may be a charging case, for storing earbuds, which may be wireless earbuds.

In some arrangements, the outer case may be configured for covering one or more earbuds, a microphone or case therefor, a voice recorder or case therefor, a remote control device or case therefor, a pager or case therefor, or a video game controller or case therefor.

In some arrangements, the outer case may further include a cushion and a ridge. The cushion may be attached to the lid. The ridge may be attached to the lid on a side of the lid opposite the cushion. The cushion may be configured to compress the one of the handheld electronic device or the handheld electronic device case covered by the outer case.

In some such arrangements, the cushion may be attached to the first lid layer and the ridge may be attached to the second lid layer.

A handheld electronic device system may include either one or both of a handheld electronic device and a handheld electronic device case configured for holding the electronic device and an outer case enclosing the one or both of the electronic device and the electronic device case in a first state and exposing the one or both of the electronic device and the electronic device case in a second state. The outer case may include a base, a lid, and a connecting portion. The base may include a first base layer which may be made of an elastomeric first material and a second base layer which may be attached to the first base layer and which may be made of a second material different from the first material. The lid may include a first lid layer which may be made of an elastomeric third material and a second lid layer which may be attached to the first lid layer and which may be made of a fourth material different from the third material. The connecting portion may be attached along a rear wall of the base and a rear wall of the lid. The rear wall of the base, the rear wall of the lid, and the connecting portion may be flush when the outer case is in a closed state with the lid covering an opening defined by the base. The connecting portion may suspend the lid when the outer case is in a fully open state with the lid spaced from the base.

In some arrangements, the handheld electronic device system may include both the handheld electronic device and the handheld electronic device case. In such arrangements, the handheld electronic device may be held within the electronic device case.

In accordance with another aspect, an outer case for covering a handheld electronic device or handheld electronic device case may include a base, a lid, and a flexible hinge. The lid may be configured for placement onto the base. The lid may have a first state in which the lid is placed on the base and a second state in which the lid is spaced from the base. The flexible hinge may be attached to the base and the lid. The flexible hinge may be in the form of a curved sheet when the lid is in the first state and may be in the form of a paraboloid when the lid is in the second state.

In accordance with another aspect of the invention, an outer case for covering a handheld electronic device or handheld electronic device case may include a base, a lid, and a collar. The lid may be pivotably attached to the base. The collar may be slidable along the base and away from the lid such that the lid rotates away from the base as the collar slides away from the lid.

In some arrangements, either one or both of the base and the lid may be made of co-molded or co-casted polymer layers. In some other arrangements, either one or both of the base and the lid may be made of a plurality of layers attached by an adhesive.

In some arrangements, an outer surface or outer surfaces of any one or any combination of the base, the lid, and the collar may include an antimicrobial substance or treatment. In such arrangements, the antimicrobial substance or treatment may be selected from the group consisting of silver and silver alloys, copper and copper alloys, organosilanes, quaternary ammonium compounds, chlorhexidine, chlorhexidine incorporated hydroxyapatite materials, chlorhexidine-containing polymers, and antibiotics.

In some arrangements, the outer case may conform to and may be configured for covering a case for storing earbuds.

In some arrangements, the outer case may be configured for covering one or more earbuds, a microphone or case therefor, a voice recorder or case therefor, a remote control device or case therefor, a pager or case therefor, or a video game controller or case therefor.

In some arrangements, the rotation of the lid away from the base may be approximately proportional to the movement of the collar away from the lid. In some such arrangements, the rotation of the lid away from the base may be non-linearly, but approximately linearly proportional to the movement of the collar away from the lid.

In some arrangements, the outer case may further include a flexible panel. In such arrangements, the lid may be attached to the collar via the flexible panel. In some arrangements, the flexible panel may act as a hinge. In some arrangements, the flexible panel may be made of a textile and the collar may be an injection-molded polycarbonate. In some such arrangements, the textile may be elastic.

In some arrangements, the lid may be rotatable away from the base about a pivot axis. In such arrangements, the collar may have a collar upper rim that remains below an interface between the lid and the base during rotation of the lid away from the base.

In some arrangements, the collar may include a first side attached to the flexible panel and a second side attached to the first side. The second side of the collar may be configured for selectively securing a side of the lid to a side of the base such that the outer case is in a closed position. In some arrangements, the collar may be slidable along the base such that the flexible panel slides with the collar during movement of the collar away from the lid. In some arrangements, the second side of the collar may be latched to the base in the closed position of the outer case. In some arrangements, the second side of the collar may be opposite the first side of the collar.

In some arrangements, at least a portion of the collar may surround an exterior of the base. In some arrangements, at least a portion of the collar may be slidable along the base.

In some arrangements, the base or the collar may include one or more flanges and the other of the base and the collar may include one or more recessed tracks. In such arrangements, the one or more flanges may protrude into and may be slidable along respective ones of the one or more tracks.

In some arrangements, the base may include an interior defining a base opening in which the lid may cover the base opening.

In some arrangements, the lid may have a first lid rim along at least a first portion of the lid, and the collar may have a collar upper rim. In such arrangements, the lid may rotate away from the base from a closed position of the outer case in which the first lid rim is in abutment with the collar upper rim to an open position of the outer case in which the first lid rim is spaced from the collar upper rim.

In some arrangements, the base may have a base rim defining a top of the base, the first lid rim may define a bottom of the lid, and the first lid rim may be recessed. In this manner, the first lid rim may extend below the base rim and the lid may cover a covered portion of the collar in the open position of the outer case.

In some arrangements, the base may be made of a rigid plastic material, and the lid may include a lid inner layer made of a flexible plastic material and a lid outer layer made of a rigid plastic material. In some such arrangements, the base may have a base rim, the lid outer layer may include the first lid rim, and the lid inner layer may include a second lid rim. In some such arrangements, the second lid rim may be in abutment with the base rim when the outer case is in the closed position. In some such arrangements, the lid inner layer may extend beyond the lid outer layer such that the lid inner layer overlaps a portion of the collar when the outer case is in the closed position.

In some arrangements, a lid exterior surface of the lid and a collar exterior surface of the collar are coextensive such that the lid and the collar exterior surfaces are flush when the outer case is in the closed position.

In some arrangements, the outer case may further include an attachment member that may extend through the base and that may be in the form of a loop. The attachment member may be made of a textile which may be flexible.

In some arrangements, the base of the outer case may define a base hole that may extend through a thickness of base. In some such arrangements, the outer case further may include a port cover. The port cover may include a cover base that may be attached to the base of the outer case and a port cover door that may be attached to the cover base. The port cover door may be rotatable from a position covering the base hole to a position exposing the base hole for insertion of components through the base hole. In some arrangements, the base hole may extend through a bottom of the base of the outer case. In some arrangements, the base hole may be configured to receive a charging plug of a charging adapter as known to those skilled in the art.

In accordance with another aspect, an outer case and a handheld electronic device system may include either one or both of a handheld electronic device and a handheld electronic device case configured for holding the electronic device. The outer case may enclose or may be configured for enclosing the one or both of the electronic device and the electronic device case in a first state and exposing the one or both of the electronic device and the electronic device case in a second state. The outer case may be any one of the aforementioned outer cases. For example, the outer case may include a base, a lid, and a collar. The lid may be pivotably attached to the base. The collar may be attached to the base and moveable away from the lid such that the lid rotates away from the base during movement of the collar away from the lid.

In accordance with another aspect, an outer case for covering a handheld electronic device or handheld electronic device case may include a base, a lid, and a collar. The collar may be attached to the base and the lid such that the lid may be pivotable about a pivot axis relative to the base. The collar may be moveable in a direction away from the lid such that the lid rotates away from the base during movement of the collar in the direction away from the lid.

In some arrangements, the outer case may further include an elastic panel. In some such arrangements, the collar may be attached to the lid via the elastic panel.

BRIEF DESCRIPTION OF THE DRAWINGS

A more complete appreciation of the subject matter of the present invention and various advantages thereof may be realized by reference to the following detailed description and the accompanying drawings, in which.

DETAILED DESCRIPTION

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

Any numerical ranges set forth herein are included to individually disclose every sub-range and number, both whole integer and partial fraction, within the disclosed range. For example, a disclosed range of 1-100 is intended to individually disclose 10-90, 40-70, 29.5-60.2, 65, 57.3, 94.512924, and every other range and number that falls within the recited range.

Figure 1:
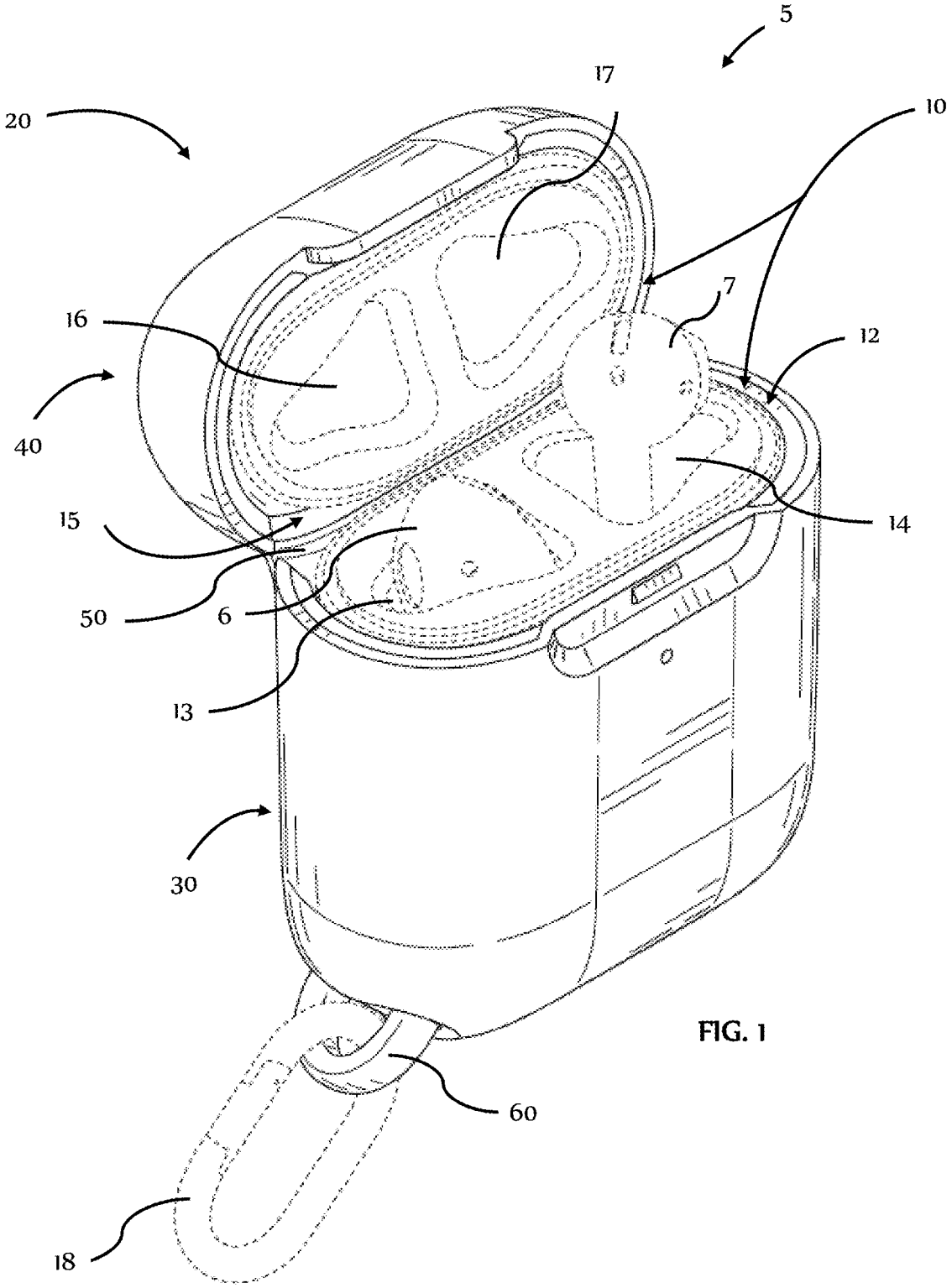
FIG. 1 is a top perspective view of an audio device system (shown in broken lines) encapsulated by a protective outer case, shown in an open state in accordance with an embodiment.

Referring now to FIG. 1, audio device system 5 includes left earbud 6, right earbud 7, charging case 10, carabiner 18, and outer case 20. Charging case 10 includes charging base 12 and charging lid 15 attached to the charging base. Charging base 12 includes left and right base cavities 13, 14 with shapes corresponding to the respective shapes of bottom portions of left and right earbuds 6, 7. Charging lid 15 includes left and right lid cavities 16, 17 with shapes corresponding to the respective shapes of top portions of left and right earbuds 6, 7 such that upon closure of the lid, the left earbud is enclosed by left base cavity 13 and the left lid cavity and the right earbud is enclosed by right base cavity 14 and right lid cavity 17.

As shown, outer case 20 includes base portion 30 and lid portion 40 attached to and closeable onto the base portion via connecting portion 50. Base portion 30 covers an entirety of an external surface of charging base 12 and lid portion 40 covers an entirety of an external surface of charging lid 15 such that upon closure of the lid portion onto the base portion of outer case 20 with charging case 10 arranged within the base portion, the entirety of the charging case is enclosed by the outer case (see FIGS. 10 and 17). During use of outer case 20 in either an open position as shown in FIGS. 2-9 or in a closed position as shown in FIGS. 10-17, only one or none of left and right earbuds 6, 7 may be suitably received in the respective left and right base cavities 13, 14 of charging base 12.

Referring now to FIGS. 2-9, base portion 30 of outer case 20 includes inner base layer 31 and outer base layer 32 attached to the inner base layer to form a base receptacle 33 defined by the inner base layer. As in the example shown, base receptacle 33 may conform or substantially conform to the shape of charging base 12 of charging case 10 such that the charging base is held in place by the base receptacle in any orientation of the charging base, including when outer case 20 is in the open position. Lid portion 40 of outer case 20 includes inner lid layer 41 and outer lid layer 42 attached to the inner lid layer to form a lid receptacle 43 defined by the inner lid layer. Lid receptacle 43 conforms or substantially conforms to the shape of charging lid 15 of charging case 10 such that the charging lid is held in place by the lid receptacle in any orientation of the charging lid, including when outer case 20 is in the open position. Either one or both of the combination of inner base layer 31 and outer base layer 32 and the combination of inner lid layer 41 and outer lid layer 42 may be co-molded/co-casted together or otherwise permanently affixed to each other, such as with an adhesive, in the manner further described in U.S. Pat. No. 8,755,852 and U.S. Patent Application Publication Nos. 2019/0075899 A1 and 2019/0075900 A1, the entireties of the disclosures of which are hereby incorporated by reference herein. Thicknesses of each of inner base layer 31, inner lid layer 41, outer base layer 32, and outer lid layer 42 may be in the range of 0.5 mm to 2.0 mm. Moreover, an overall thickness of each of the combination of inner base layer 31 and outer base layer 32 and the combination of inner lid layer 41 and outer lid layer 42 may be in the range of 1.0 mm to 5.0 mm. In some arrangements, either one or both of the combination of inner base layer 31 and outer base layer 32 may be a single base layer and the combination of inner lid layer 41 and outer lid layer 42 may be a single lid layer.

Figure 2:
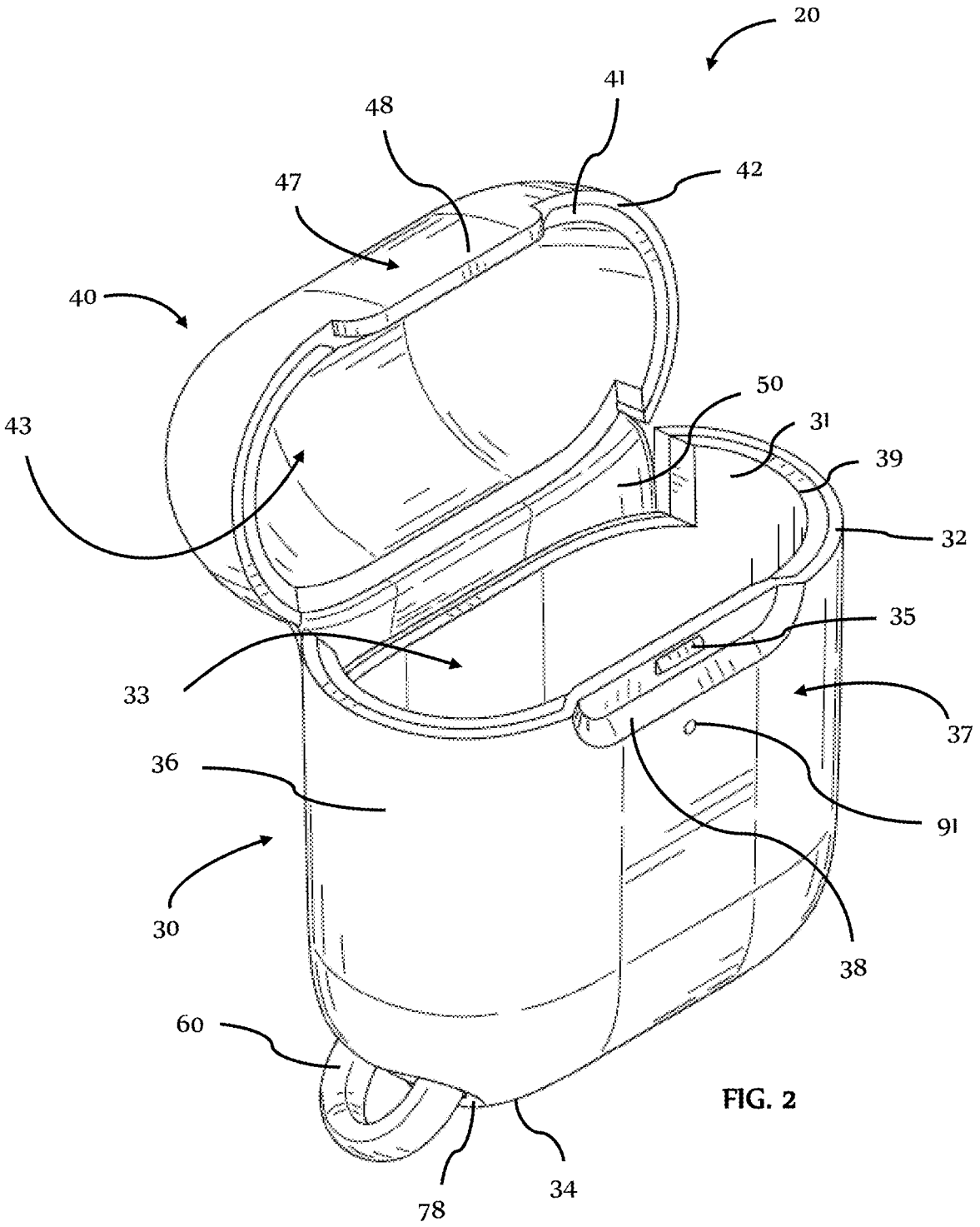
FIG. 2 is a top perspective view of the outer case of FIG. 1, shown in the open state, in accordance with an embodiment.
Figure 3:
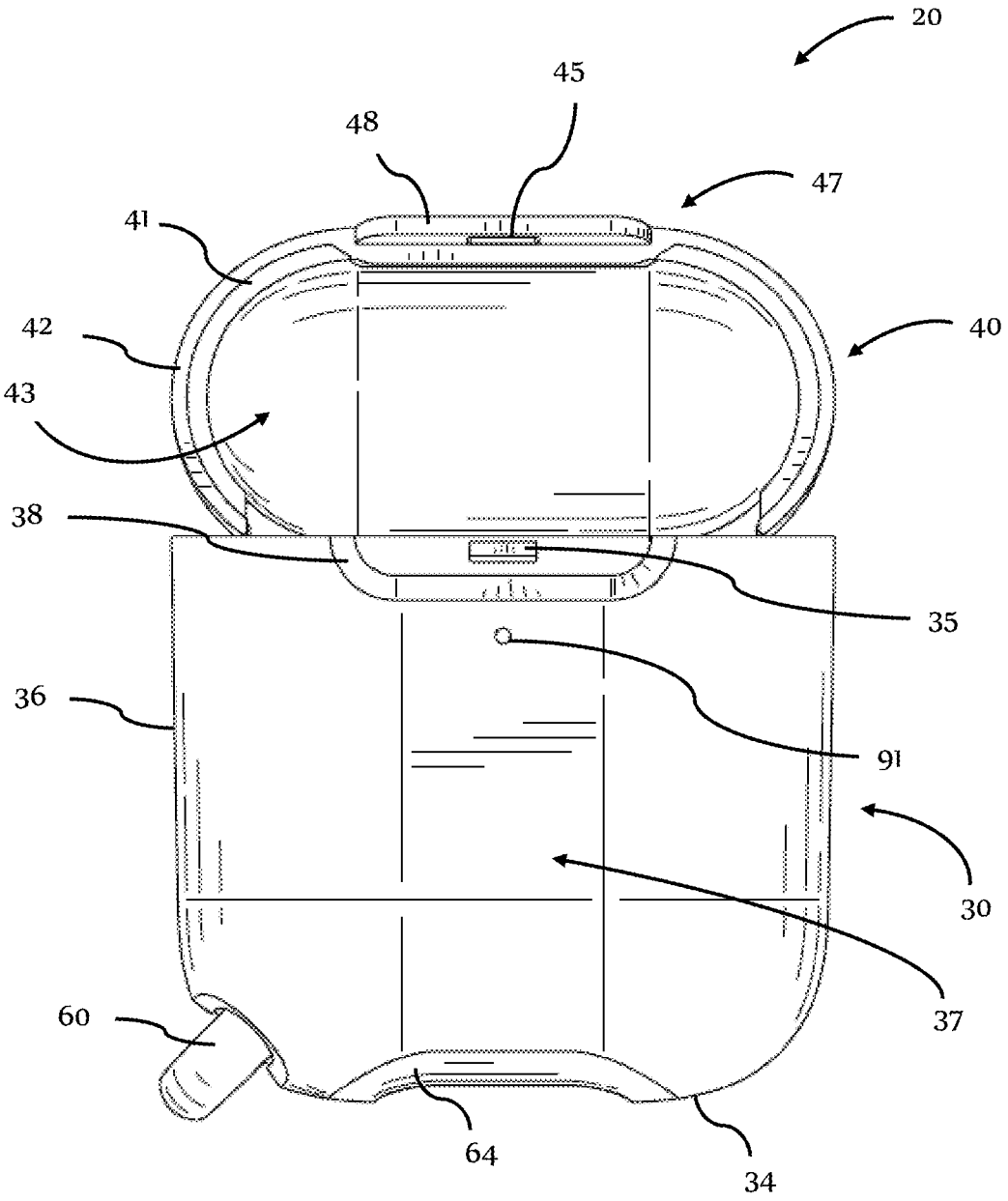
FIG. 3 is a front view of the outer case of FIG. 2, shown in the open state.
Figure 4:
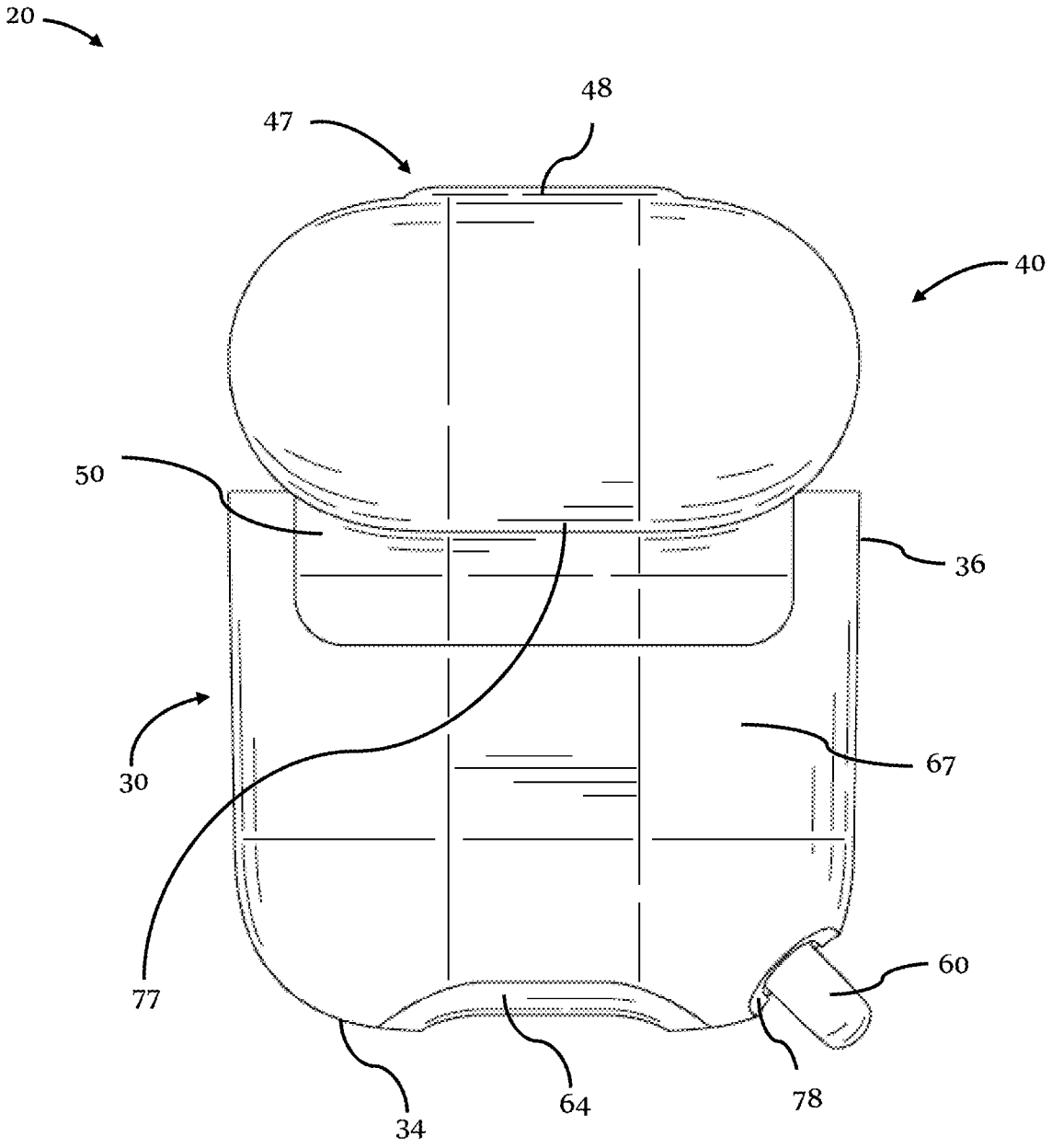
FIG. 4 is a rear view of the outer case of FIG. 2, shown in the open state.
Figure 5:
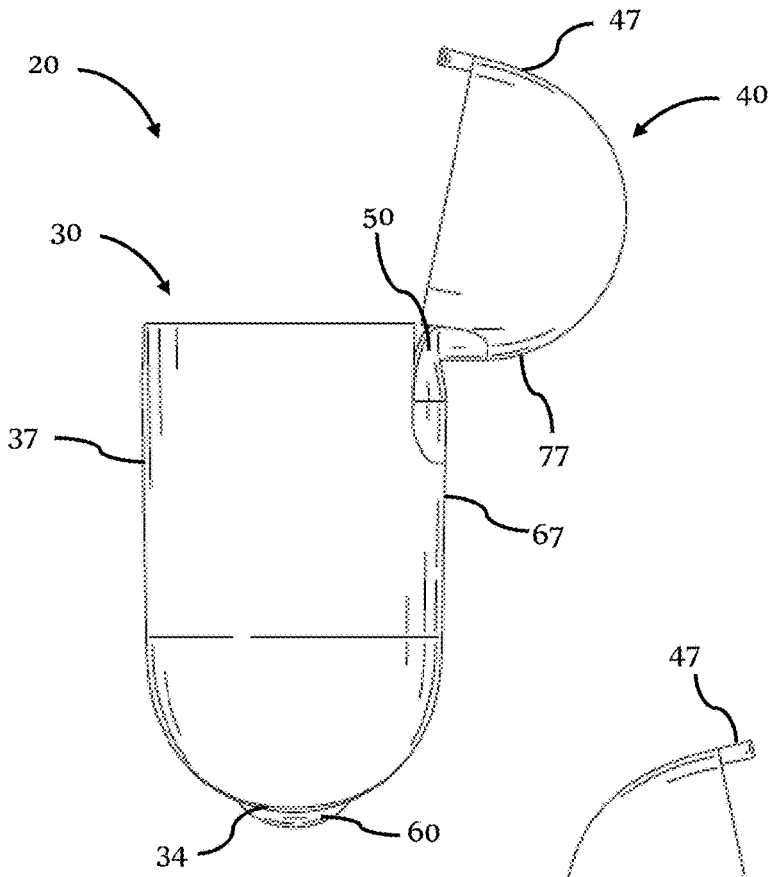
FIG. 5 is a right side view of the outer case of FIG. 2, shown in the open state.
Figure 6:
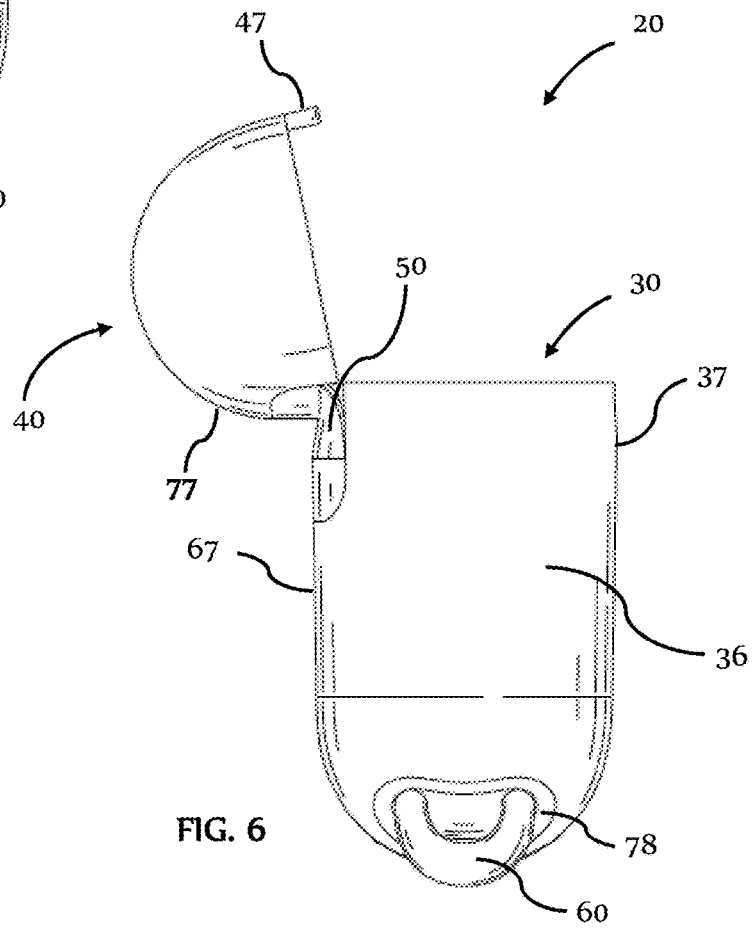
FIG. 6 is a left side view of the outer case of FIG. 2, shown in the open state.
Figure 7:
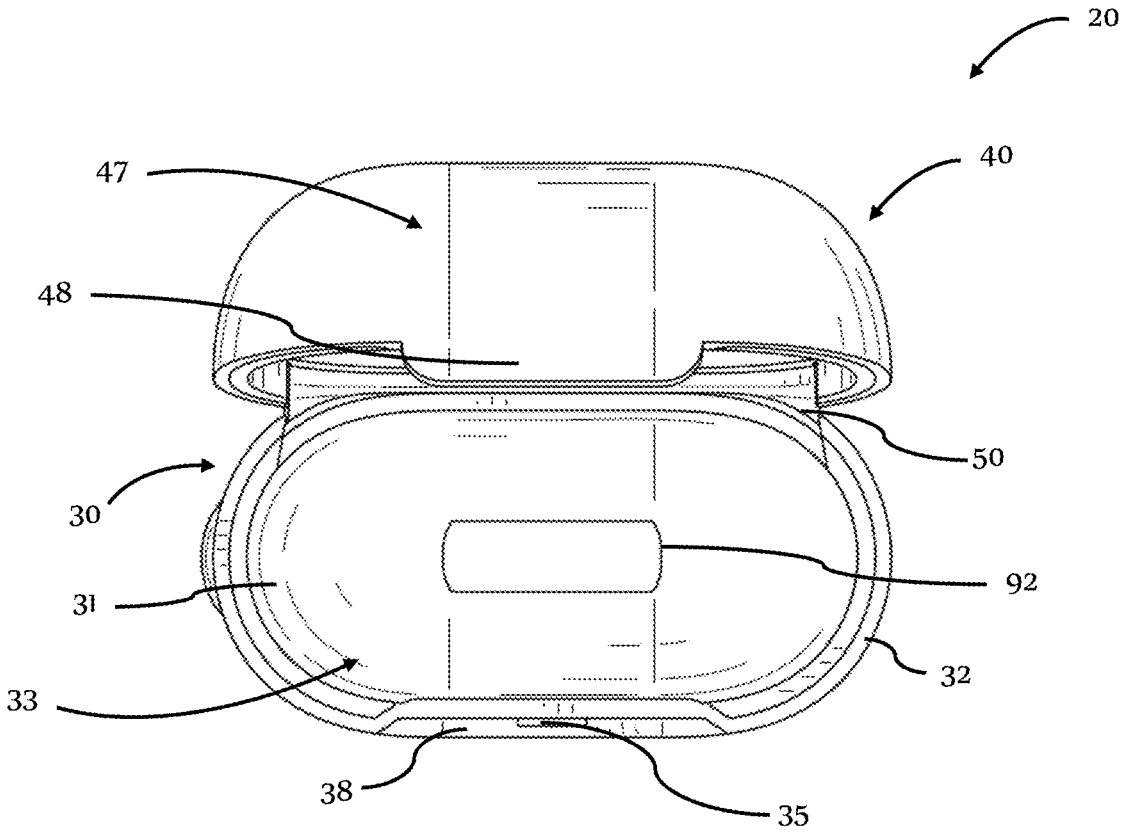
FIG. 7 is a top view of the outer case of FIG. 2, shown in the open state.
Figure 8:
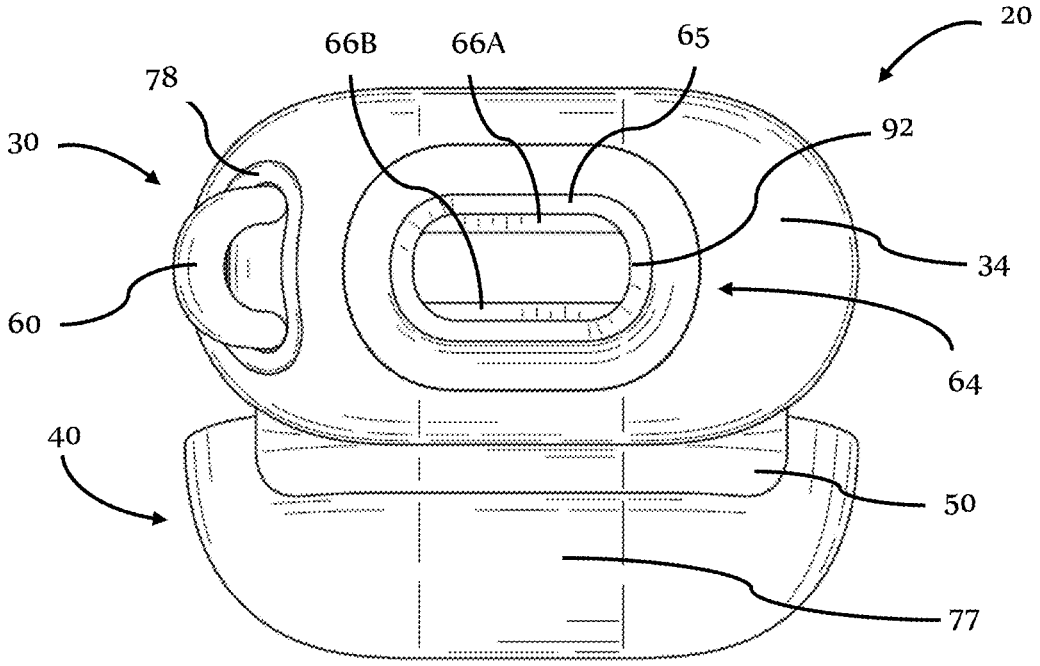
FIG. 8 is a bottom view of the outer case of FIG. 2, shown in the open state.
Figure 9:
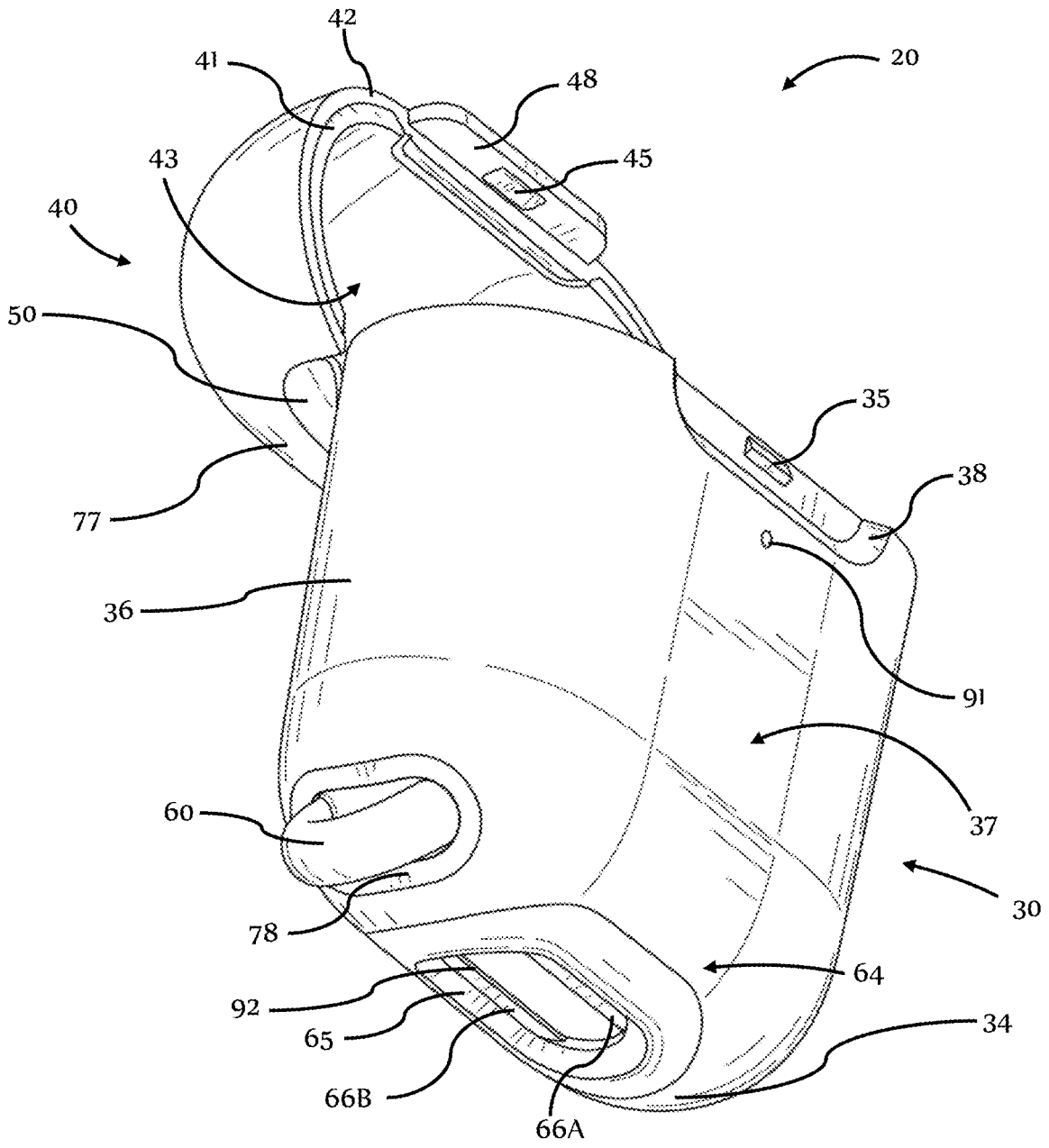
FIG. 9 is a bottom perspective view of the outer case of FIG. 2, shown in the open state.
Figure 10:
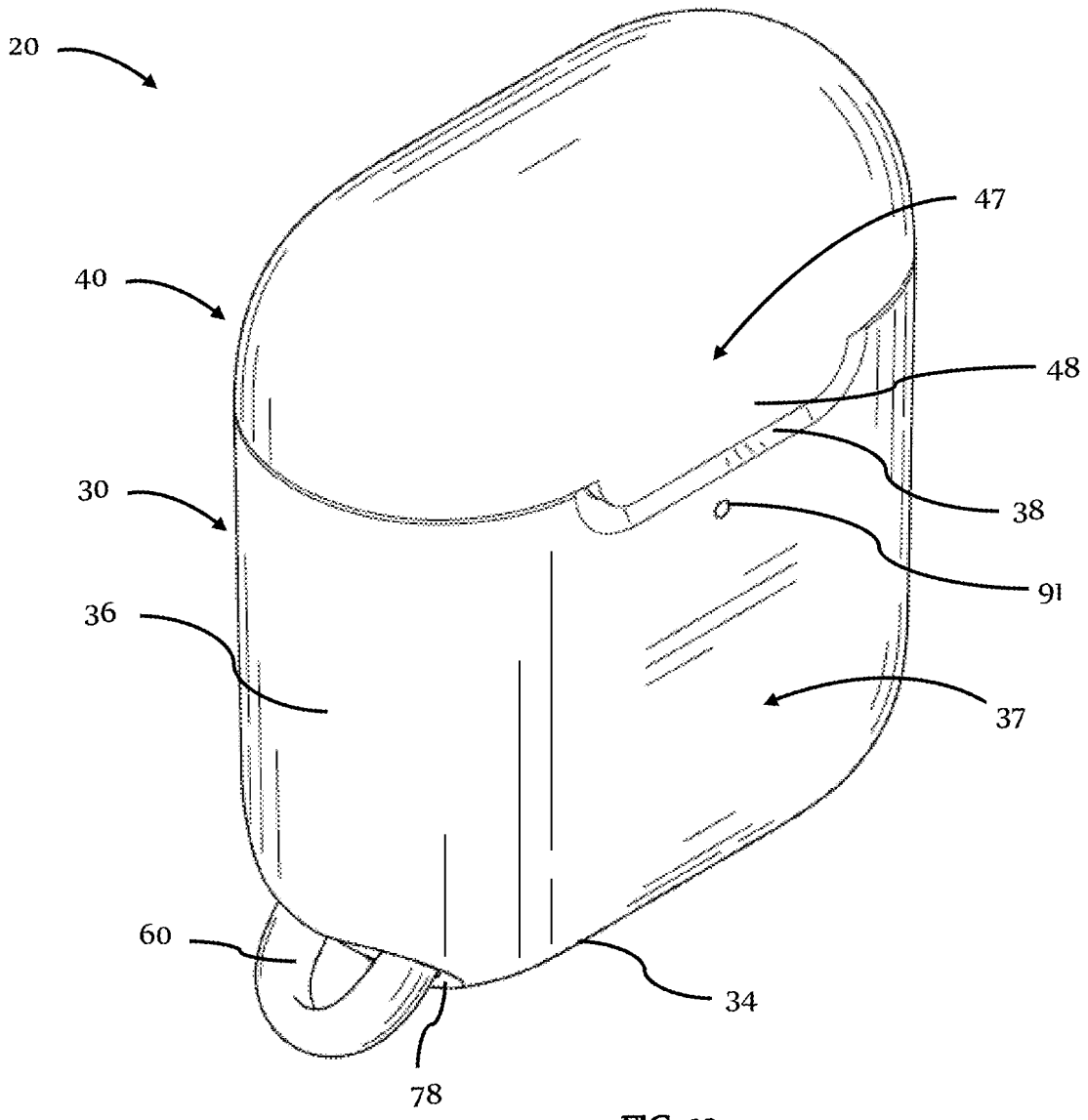
FIG. 10 is a top perspective view of the outer case of FIG. 1, shown in the closed state in accordance with another embodiment.
Figure 11:
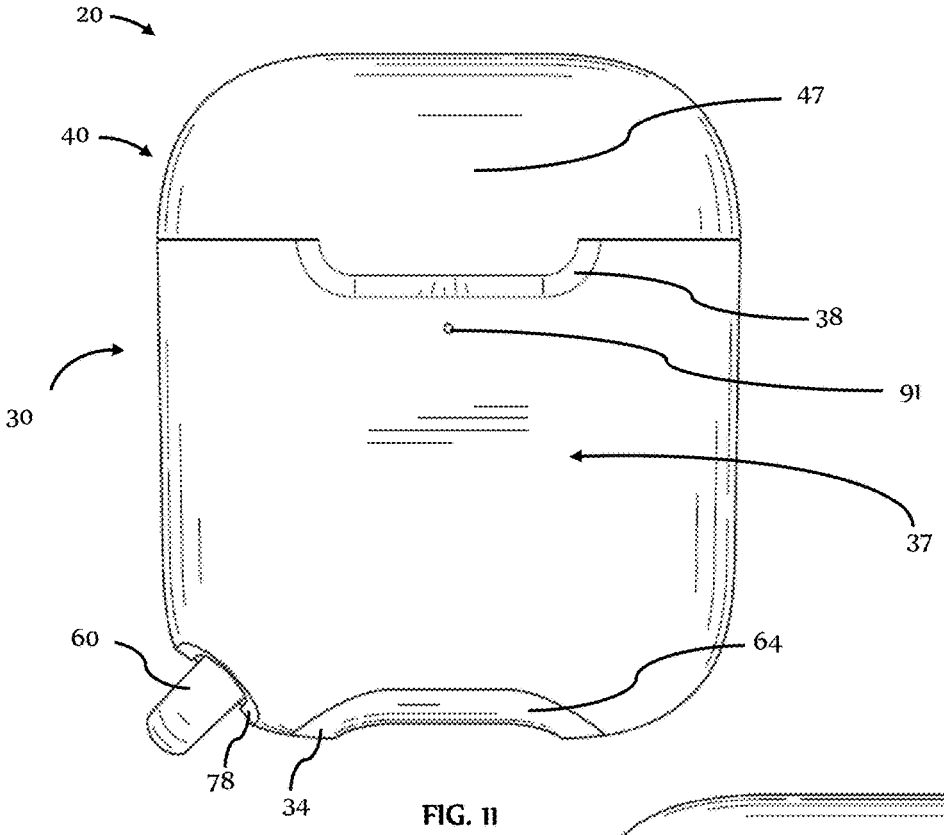
FIG. 11 is a front view of the outer case of FIG. 10, shown in the closed state.
Figure 12:
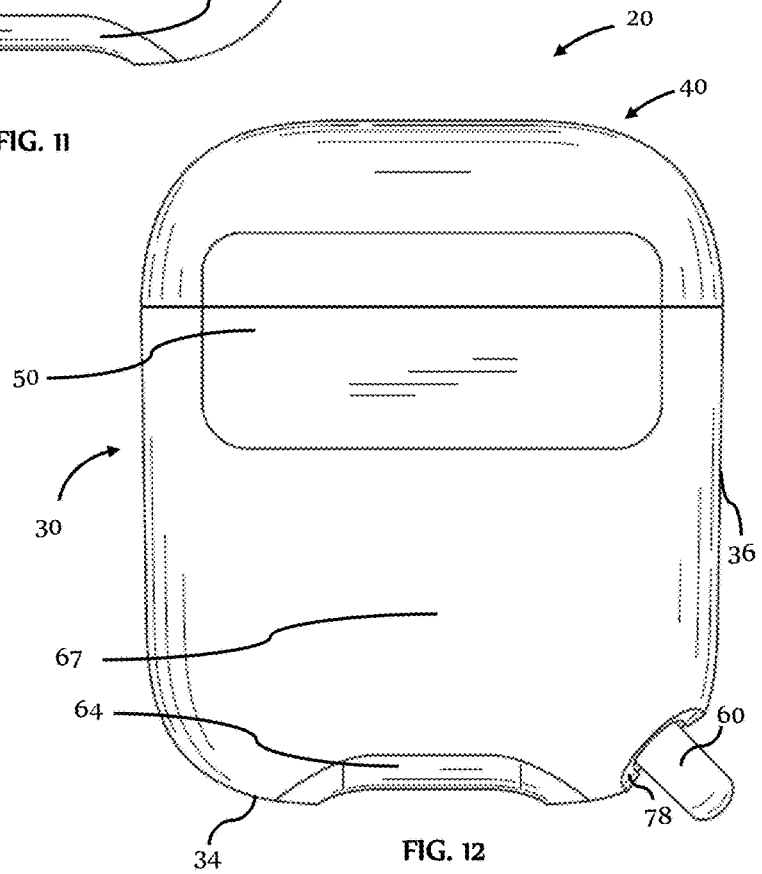
FIG. 12 is a rear view of the outer case of FIG. 10, shown in the closed state.
Figure 13:
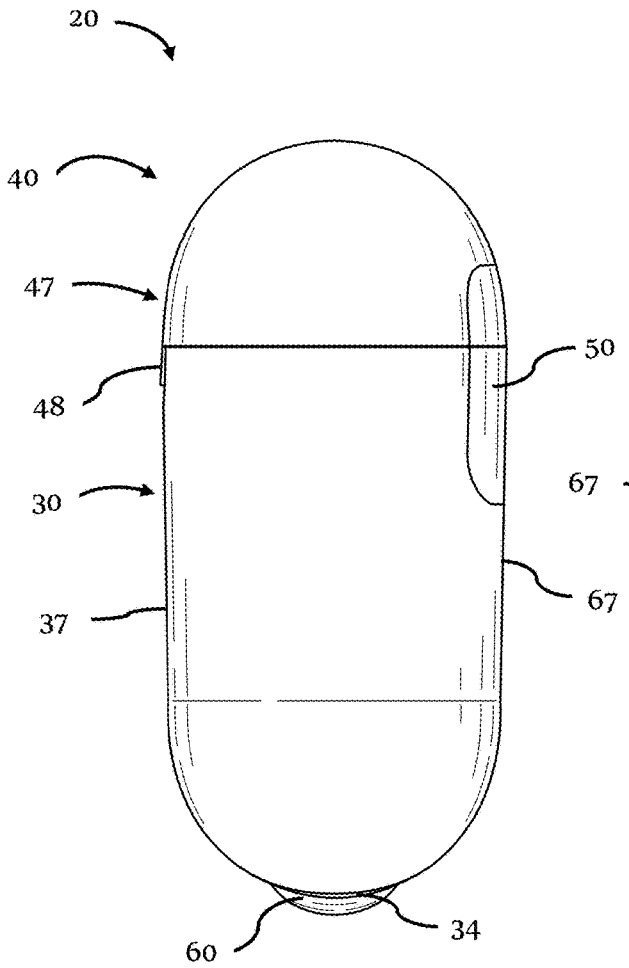
FIG. 13 is a right side view of the outer case of FIG. 10, shown in the closed state.
Figure 14:
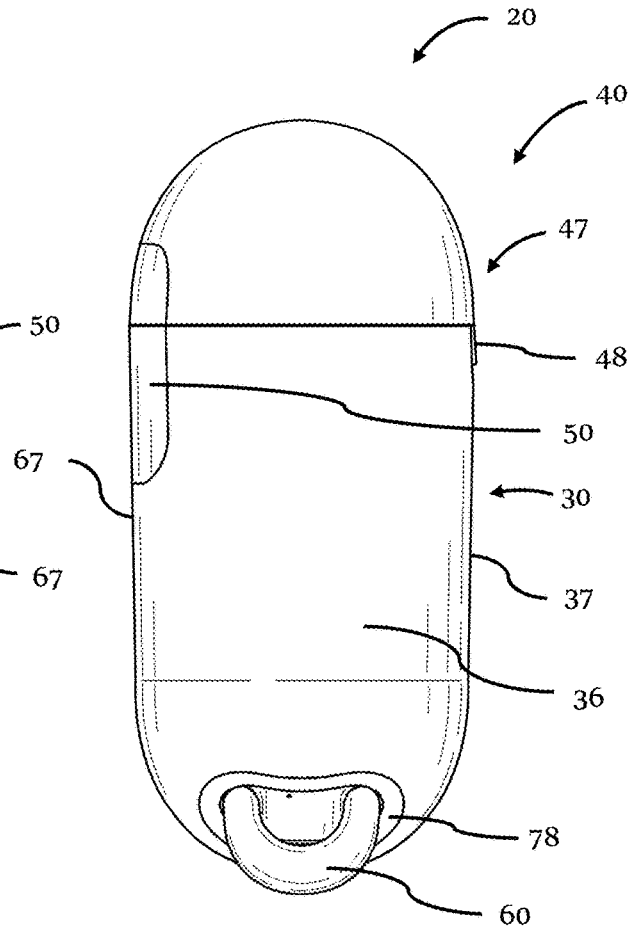
FIG. 14 is a left side view of the outer case of FIG. 10, shown in the closed state.
Figure 15:
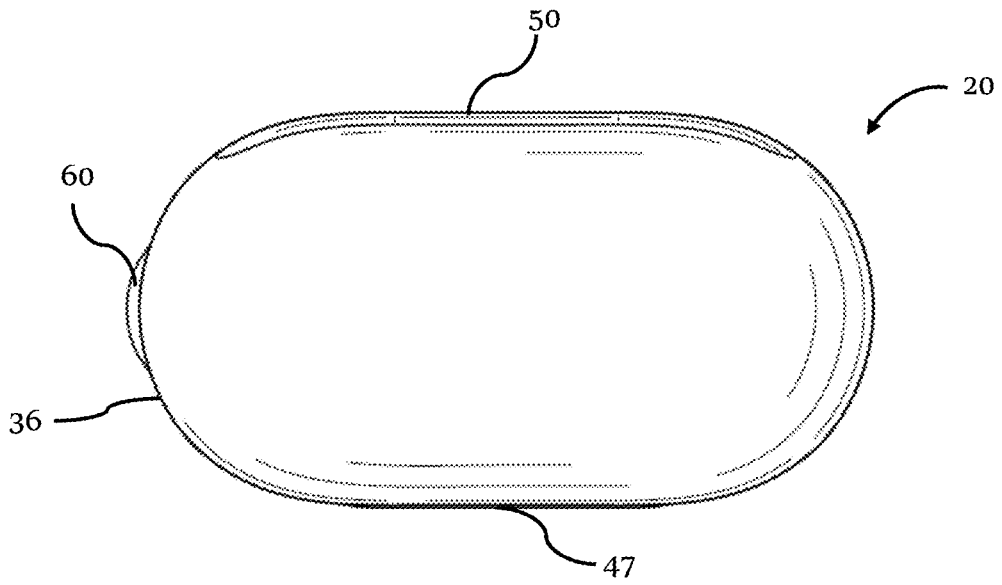
FIG. 15 is a top view of the outer case of FIG. 10, shown in the closed state.
Figure 16:
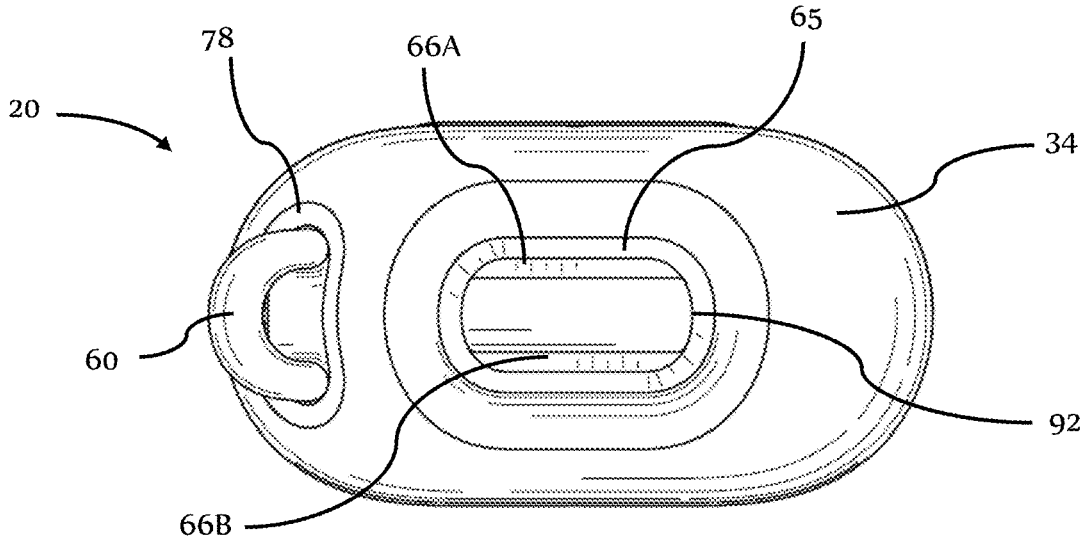
FIG. 16 is a bottom view of the outer case of FIG. 10, shown in the closed state.
Figure 17:
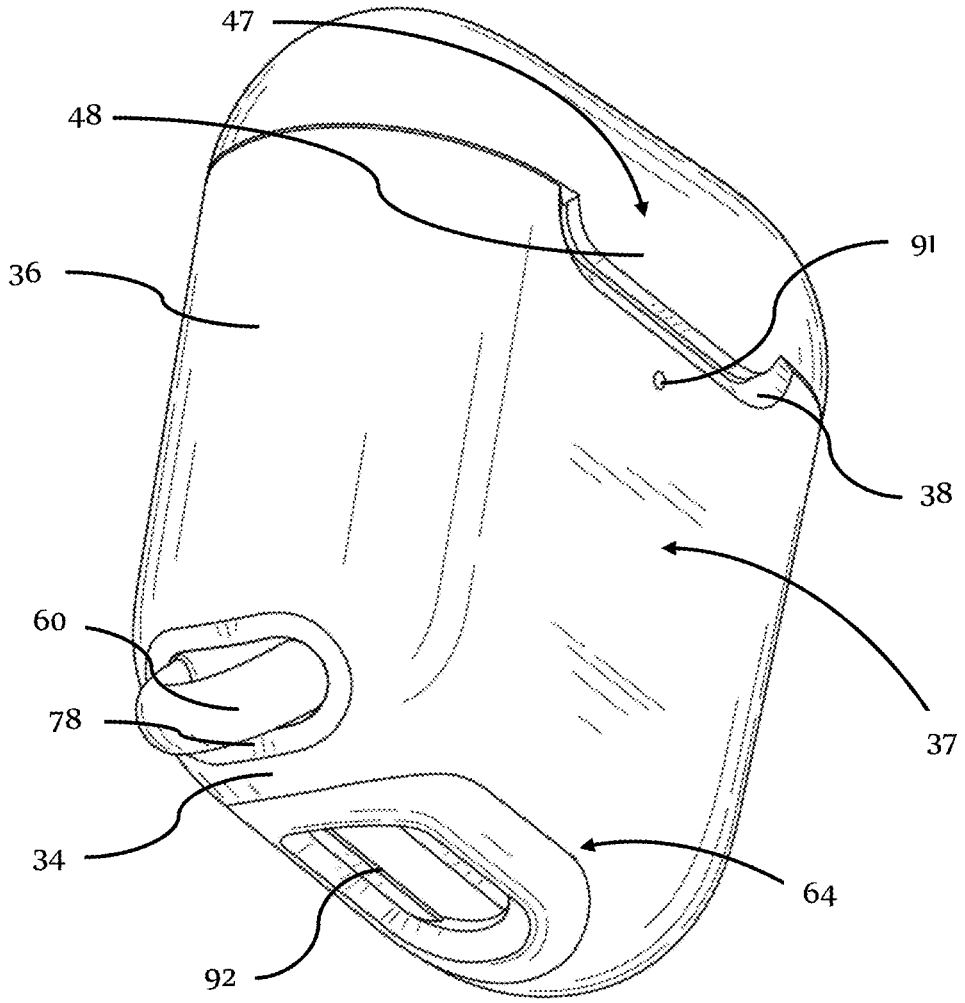
FIG. 17 is a bottom perspective view of the outer case of FIG. 10, shown in the closed state.

As shown for example in FIG. 2, connecting portion 50 acts as a flexible hinge. In this example, connecting portion 50 extends across and along rear wall 67 of base portion 30 and rear wall 77 of lid portion 40. In this example, connecting portion 50 is overmolded onto lid portion 40 and includes tabs (not shown) snapped into corresponding holes of outer base layer 32 to inhibit pull out of the connecting portion from the outer base layer and retain the connecting portion in the outer base layer. In alternative arrangements, the connecting portion may be overmolded onto base portion 30 and snapped into corresponding holes of outer lid layer 42. In other alternative arrangements, the connecting portions may be attached to the base portion and the lid portion in another manner, such as through the use of an adhesive or by way of other mechanical connections. When outer case 20 is in the closed position, connecting portion 50 is generally in the form of a curved sheet, as shown for example by FIGS. 12-14. In this manner, rear wall 67 of base portion 30, connecting portion 50, and rear wall 77 of lid portion 40 are flush when outer case 20 is in the closed position such that these portions do not catch on other objects during use of the outer case. When outer case 20 is in the open position, connecting portion 50 is generally in the form of a paraboloid, as shown for example by FIGS. 2, 5, and 6. In this manner, lid portion 40 attached to connecting portion 50 rotates upwardly and away from base portion 30 during opening of outer case 20.

As shown, outer case 20 further includes attachment loop 60 extending from base portion 30. A separate hook, key ring, carabiner 18, and the like may be attached to attachment loop 60 for easier carrying of outer case 20 and its contents or attachment of outer case 20 and its contents to another object such as a bag or belt loop of a user. Attachment loop 60 extends from inner base layer 31 and through an opening defined by outer base layer 32. In some arrangements, attachment loop 60 is integral with inner base layer 31 such that the attachment loop and the inner base layer are inseparable without fracture. In other arrangements, attachment loop 60 may be attached to inner base layer 31 by an adhesive, by way of a tight interference fit within the inner base layer, by way of a flange extending from the attachment loop and preventing separation of the attachment loop from the inner base layer, or by other means known to those skilled in the art. As in the example shown, a corner formed by bottom wall 34 and side wall 36 of base portion 30 may be truncated such that a substantial portion of attachment loop 60 (see FIG. 3) extends at an oblique angle to the bottom wall and the sidewall of the base portion within the truncated region of the base portion. In this manner, attachment loop 60 is configured to minimize possible snags on or other interference with objects in the external environment. Attachment loop 60 extends from and, in the example shown, is integral with loop insert 78. Loop insert 78 includes tabs (not shown) snapped into corresponding holes of outer base layer 32 to inhibit pull out of the loop insert from the outer base layer and retain the loop insert in the outer base layer. In some alternative arrangements, attachment loop 60 may be in the form of a hook. In this manner, attachment loop 60 may be attached directly to a bag or belt loop or other object.

Front wall 37 of base portion 30 of outer case 20 includes base flange 35 set into and extending from base recess 38 of the base portion, and front wall 47 of lid portion 40 of the outer case includes lid flange 45 set into and extending from lid flap 48 of the lid portion. Lid flap 48 is located on lid portion 40 and base recess 38 is located on base portion 30 such that upon closure of outer case 20, the lid flap is received within the base recess as shown in FIGS. 10, 11, and 13-17. Lid flange 45 is aligned with base flange 35 such that upon closure of outer case 20, the lid flange overlaps and is below the base flange such that the base flange is closer to base opening 39 of base receptacle 33 than the lid flange. As in the example shown, either one or both of base flange 35 and lid flange 45 is configured with an undercut such that a tip of the other of the base flange and the lid flange is received within such undercut or undercuts when outer case 20 is in the closed position. The use of the undercuts inhibits relative slipping between the base and lid flanges 35, 45, allowing the closure of base portion 30 onto lid portion 40 to be more secure. In some alternative arrangements, one or more dual hinge latches as known to those skilled in the art may be utilized in place of or in combination with flanges like those of base and lid flanges 35, 45. Such dual hinge latches may be in the form of latches used on fishing tackle boxes sold commercially today.

As in the example shown in FIGS. 1-17, outer case 20 may define additional openings or cutouts at various locations so as to allow various buttons, ports, or features of a protected device, such as charging case 10, to be accessed without having to remove the protected device 10 from the outer case. For example, opening 91 through front wall 37 of outer case 20 is configured to expose a light indicator, e.g., a light-emitting diode (LED) indicator, of charging case 10 to allow a user to be alerted when charging of earbuds 6, 7 is complete or when additional charging is needed, depending on the default settings of the LED indicator. As another example, opening 92 extends through port insert 64 received in a hole defined by bottom wall 34 to provide access to a charging port of charging base 12. In this example, port insert 64 includes tabs (not shown) snapped into corresponding holes of outer base layer 32 to inhibit pull out of the port insert from the outer base layer and retain the port insert in the outer base layer. Port insert 64 includes port body 65 and port ribs 66A, 66B attached on opposite sides of a top portion of the port body. Port body 65 defines a lead-in chamfer and port ribs 66A, 66B in combination with the top portion of the port body define opening 92. The lead-in chamfer of port body 65 and port ribs 66A, 66B provide a guide for the insertion of a peripheral component, such as a connector of a power plug, through opening 92 in which the port ribs provide a slight resistance during the insertion of the peripheral component and thereby provide tactile feedback to a user that the connector is received in the opening.

Inner base layer 31, inner lid layer 41, and port insert 64 preferably may be made of elastomeric or other suitably flexible materials. Preferred materials include thermosetting plastics with a hard durometer having shore 30D to shore 100D, polycarbonate, poly(methyl methacrylate) ("PMMA"), metals, acrylonitrile butadiene styrene ("ABS"), PMMA, polyethylene terephthalate ("PET"), high durometer thermoplastic elastomers ("TPEs") and thermoplastic polyurethanes ("TPUs") having shore 30D to shore 100D, and any combination thereof. In some arrangements, either one or both of inner base layer 31 and inner lid layer 41 may be made of a non-Newtonian dilatant material, as further described in U.S. Patent Application Publication Nos. 2019/0075899 A1 and 2019/0075900 A1. Inner base layer 31 and inner lid layer 41 preferably are made of the same material, although these layers may be made of different materials.

Outer base layer 32 and outer lid layer 42 preferably may be made of a rigid or hard material to create a rigid/hard shell which provides at least some impact protection as well as protection from being punctured by impacts with sharp objects. Preferred hard/rigid materials include hardened plastic material, a rigid or semi-rigid plastic material, a rigid/hard rubber material, a polycarbonate material, a metal, an alloy, a para-aramid material, wood, glass, mirror, quartz, and any combination thereof, and may be any color or texture. Such materials may be the same as or may mimic the material or materials used for charging case 10. Outer base layer 32 and outer lid layer 42 preferably are made of the same material, although these layers may be made of different materials.

Any one or any combination of surfaces of inner base layer 31, outer base layer 32, inner lid layer 41, and outer lid layer 42 exposed to users in either one or both of the open and closed positions of outer case 20 may be treated with an antimicrobial material applied as a coating or any one of such layers 31, 32, 41, 42 may have an antimicrobial material embedded into such layers. Preferred antimicrobial materials include silver or silver alloy (e.g., silver sodium hydrogen zirconium phosphate), copper or copper alloy, organosilanes, quaternary ammonium compounds (e.g., dimethyloctadecyl (3-trimethoxysilyl propyl) ammonium chloride, alkyldimethylbenzylammonium chloride, and didecyldimethylammonium chloride), chlorhexidine, chlorhexidine incorporated hydroxyapatite materials, chlorhexidine-containing polymers (e.g., chlorhexidine-containing polylactide), and antibiotics (e.g., gentamicin, cephalothin, carbenicillin, amoxicillin, cefamandol, tobramycin, vancomycin). Preferred antimicrobial coatings include coatings containing any of the aforementioned antimicrobial materials, chlorhexidine-containing polylactide coatings on an anodized surface, and polymer and calcium phosphate coatings with chlorhexidine. These antimicrobial treatments aid in reducing the presence and preventing the growth of microbes (e.g., bacteria, fungi, viruses, etc.), thereby aiding in preventing the spread of related sicknesses, illnesses, or diseases.

Figure 18:
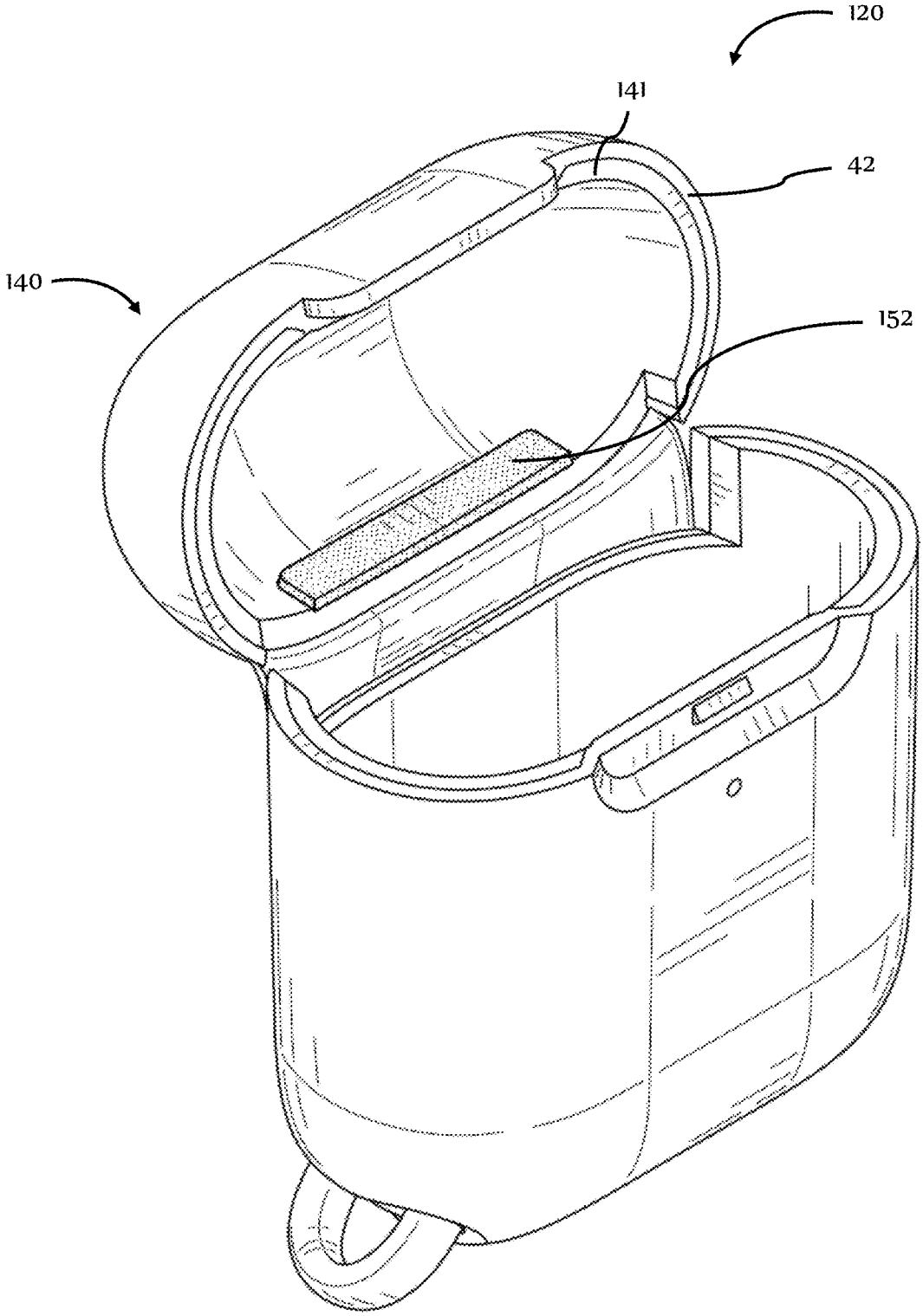
FIG. 18 is a top perspective view of a protective outer case, shown in an open state, in accordance with another embodiment.
Figure 19:
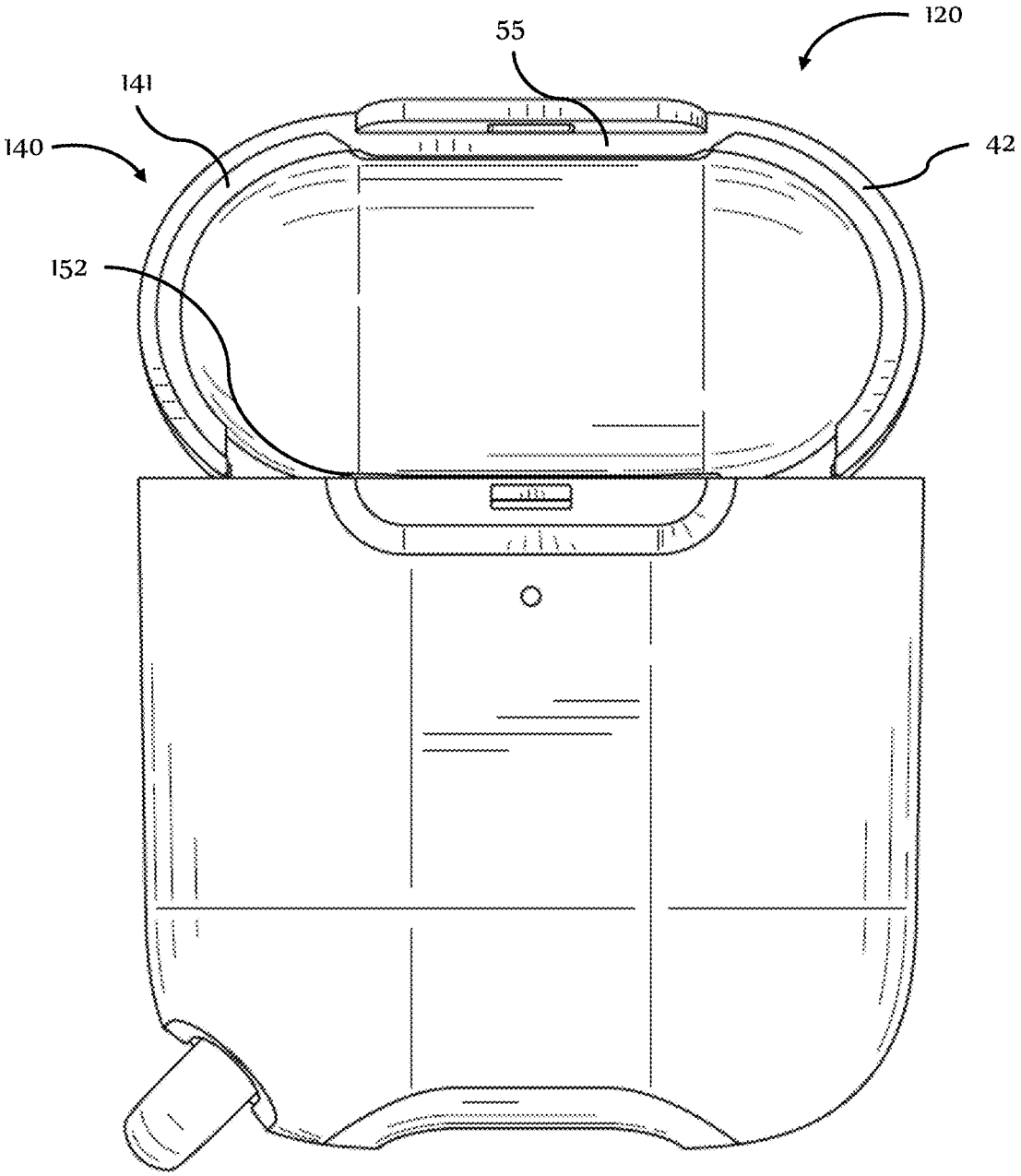
FIG. 19 is a front view of the outer case of FIG. 18, shown in the open state.
Figure 20:
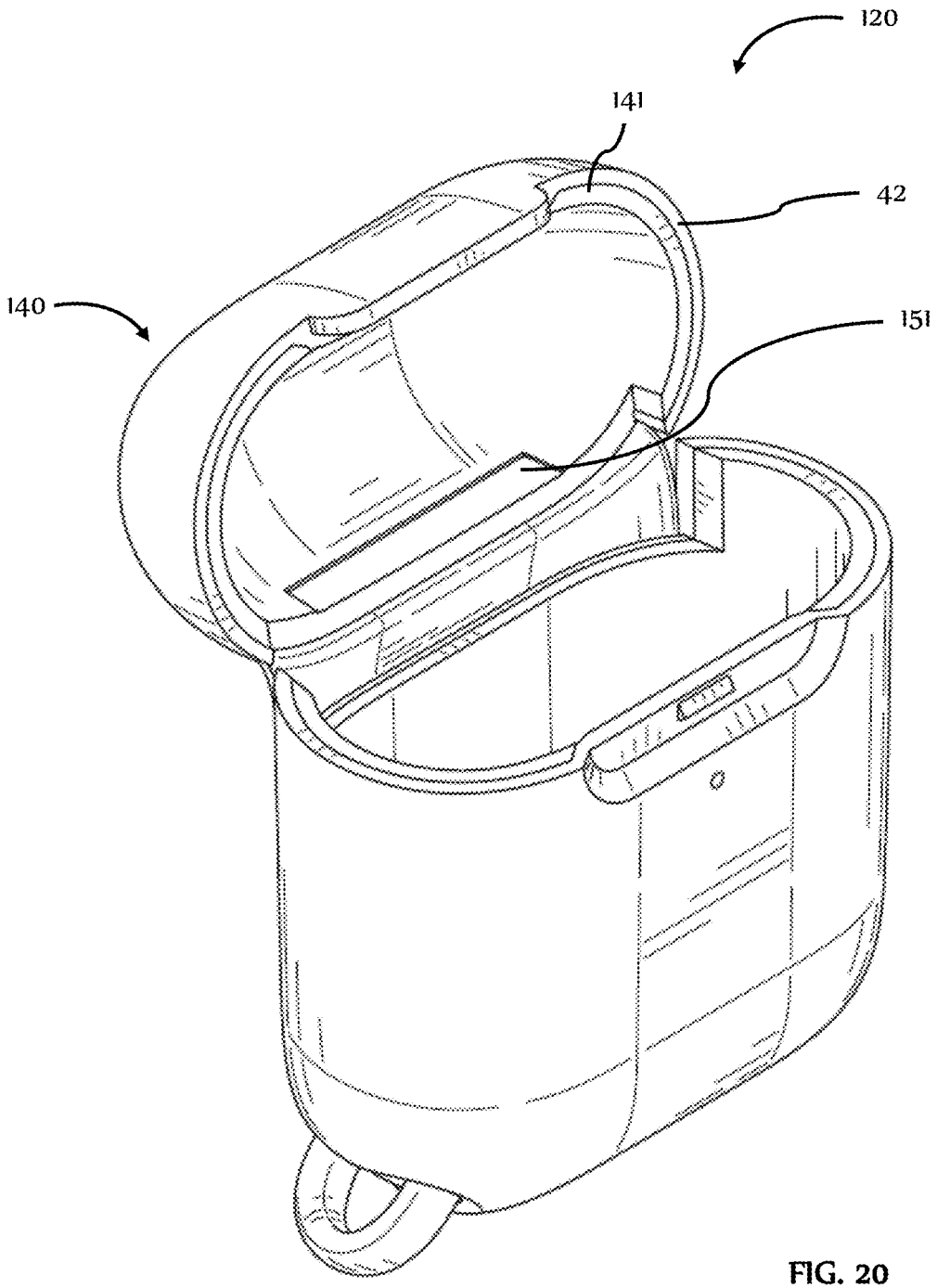
FIG. 20 is a top perspective view of a protective outer case, shown in the open state, in accordance with another embodiment.

Referring now to FIGS. 18-20, in an alternative arrangement, outer case 120 is the same or substantially the same as outer case 20 with the exception that outer case 120 includes lid 140 in place of lid 40. Lid 140 is the same or substantially the same as lid 40 with the exception that lid 140 includes inner lid layer 141 defining recess 151 and further includes cushion 152 received in the recess. Cushion 152 extends beyond inner lid layer 141 and is oriented such that the cushion opposes ridge 55 of outer lid layer 42. In this manner, upon insertion of charging lid 15 of charging case 10 into outer case 120, cushion 152 and ridge 55 each contact the charging lid to aid in retaining the charging lid in place in the outer case. As in the example shown, cushion 152 may be made of silicone or other elastic material such that the cushion may be flexible to provide an interference fit with an inserted charging lid 15 and to provide a frictional surface to further aid in retaining the charging lid in outer case 120.

Figure 21:
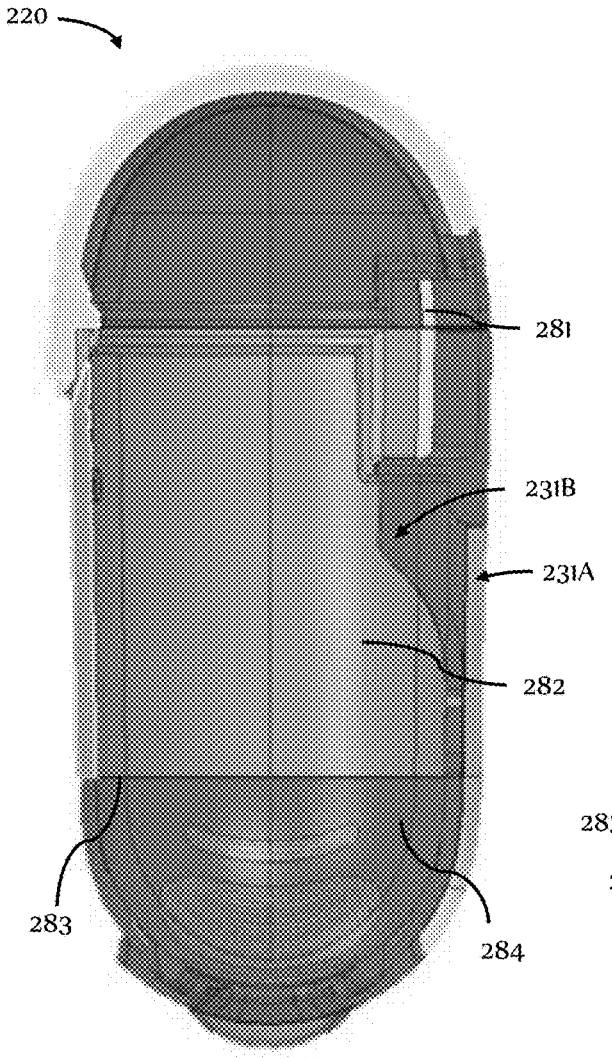
FIG. 21 is a cross-sectional right side view of a protective outer case, shown in a closed state, in accordance with another embodiment.
Figure 22:
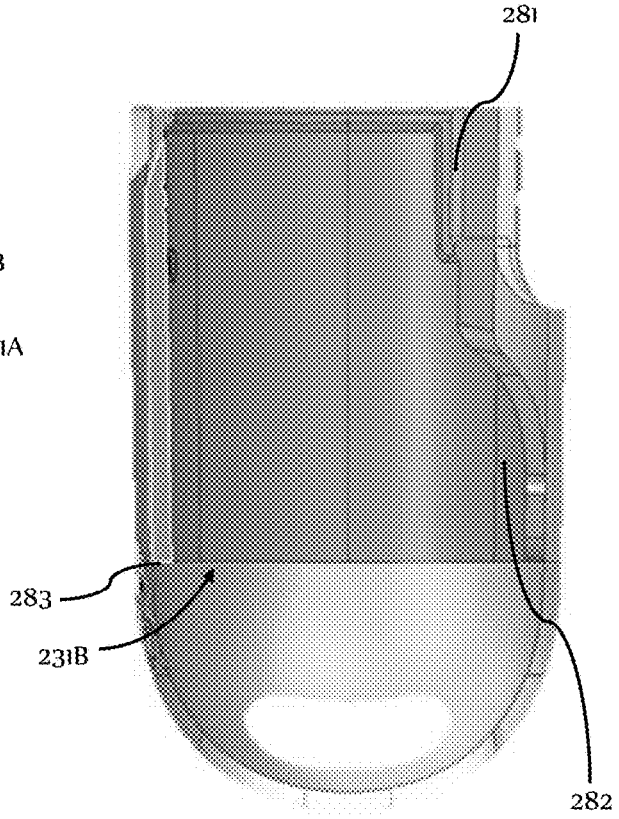
FIG. 22 is a cross-sectional right side view of an in-process protective outer case.

Referring now to FIGS. 21 and 22, in another alternative arrangement, outer case 220 is the same or substantially the same as outer case 20 with the exception that outer case 220 includes upper inner base layer 231A and lower inner base layer 231B in place of inner base layer 31. Lower inner base layer 231B is symmetrical about an axis extending from the top to the bottom of outer case 220 and further has a substantially hourglass shape defined by upper wings 281 (only one upper wing being shown as the other wing is symmetrical to the upper wing shown) and lower wings 282 (only one lower wing being shown as the other wing is symmetrical to the lower wing shown) and upper base layer 231A extends within the rest of outer case 220 such that, together, upper inner base layer 231A and lower inner base layer 231B take the same form as inner base layer 31 of outer case 20. A thickness of lower inner base layer 231B defines undercut 283 that extends over bottom portion 284 of upper inner base layer 231A to inhibit pull out of the upper inner base layer from outer case 220. A thickness of upper inner base layer 231A extends over lower wings 282 of lower inner base layer 231B to inhibit pull out of the lower inner base layer from outer case 220.

Figure 23:
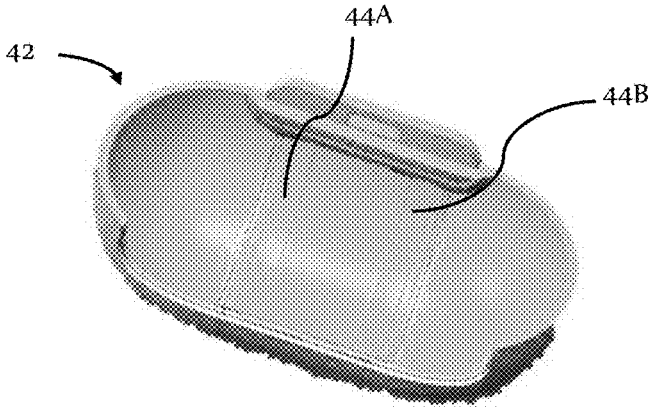
FIG. 23 is a bottom perspective view of an outer lid layer of the outer cases of FIGS. 1, 10, 18, and 20 in accordance with another embodiment.

As shown in FIG. 23, an underside of outer lid layer 42 includes a pair of bumps 44A, 44B having central axes extending within parallel planes. Outer lid layer 42 is utilized for outer cases 20, 120, 220, and the like.

Figure 24:
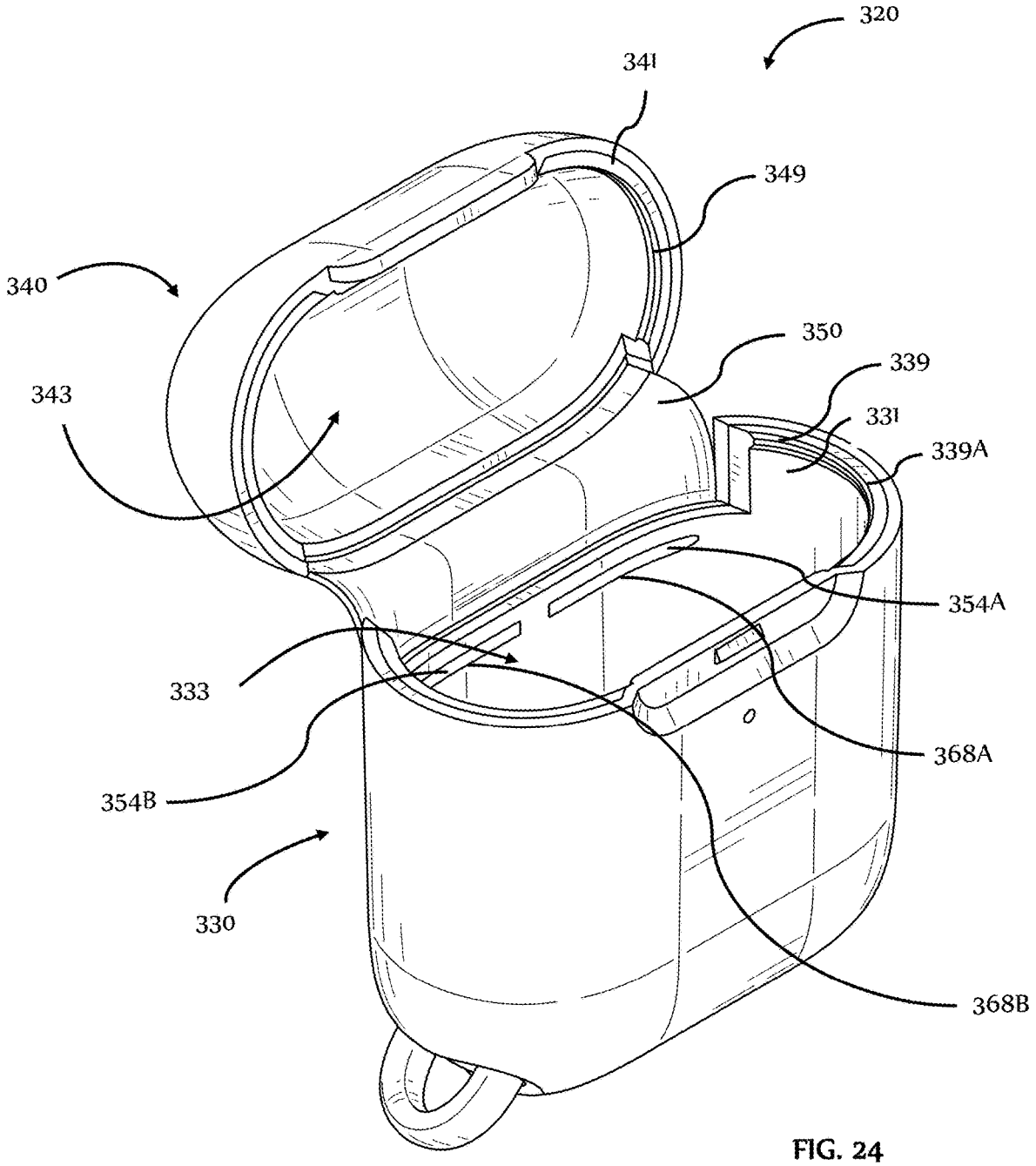
FIG. 24 is a top perspective view of a protective outer case, shown in an open state, in accordance with another embodiment.
Figure 25:
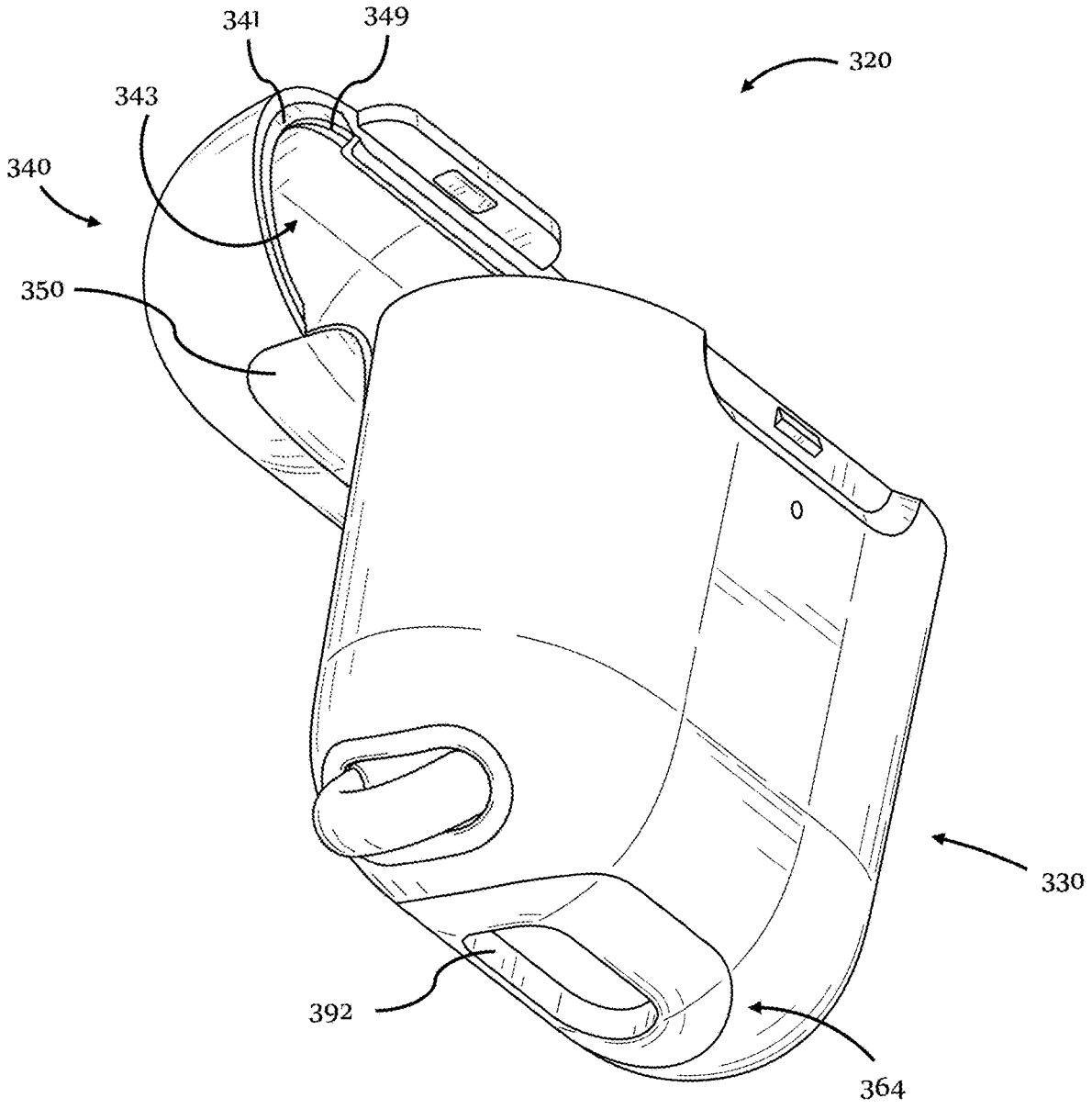
FIG. 25 is a bottom perspective view of the outer case of FIG. 24, shown in the open state.

Referring now to FIGS. 24 and 25, in yet another alternative arrangement, outer case 320 is substantially the same as outer case 20 with the notable exceptions that outer case 320 generally includes base 330 in place of base 30, lid 340 in place of lid 40, and connecting portion 350 in place of connecting portion 50. Base 330 includes inner base layer 331 having base ribs 339 that define opening 339A along a top portion of the inner base layer in place of inner base layer 31 that excludes such base ribs. Base ribs 339 provide additional friction against charging base 12, relative to surfaces without such ribs, when the charging base is inserted into base receptacle 333 defined by inner base layer 331. Base 330 further includes port insert 364 which is substantially the same as port insert 64 with the notable exception that port insert 364 excludes port ribs 66A, 66B such that opening 392 defined by the port insert provides less resistance to any connector of a power cord or other peripheral device inserted into the opening. Connecting portion 350 of outer case 320 includes tabs 354A, 354B that, unlike the corresponding tabs of connecting portion 50 of outer case 20, extend into corresponding holes 368A, 368B of inner base layer 331. In this manner, unlike inner base layer 31 of outer case 20, inner base layer 331 does not press against tabs 354A, 354B.

Lid 340 includes inner lid layer 341 having lid ribs 349 along a bottom portion of the inner lid layer in place of inner lid layer 41 that excludes such lid ribs. Lid ribs 349 provide additional friction against charging lid 15, relative to surfaces without such ribs, when the charging lid is inserted into lid receptacle 343 defined by inner lid layer 341.

Figure 26:
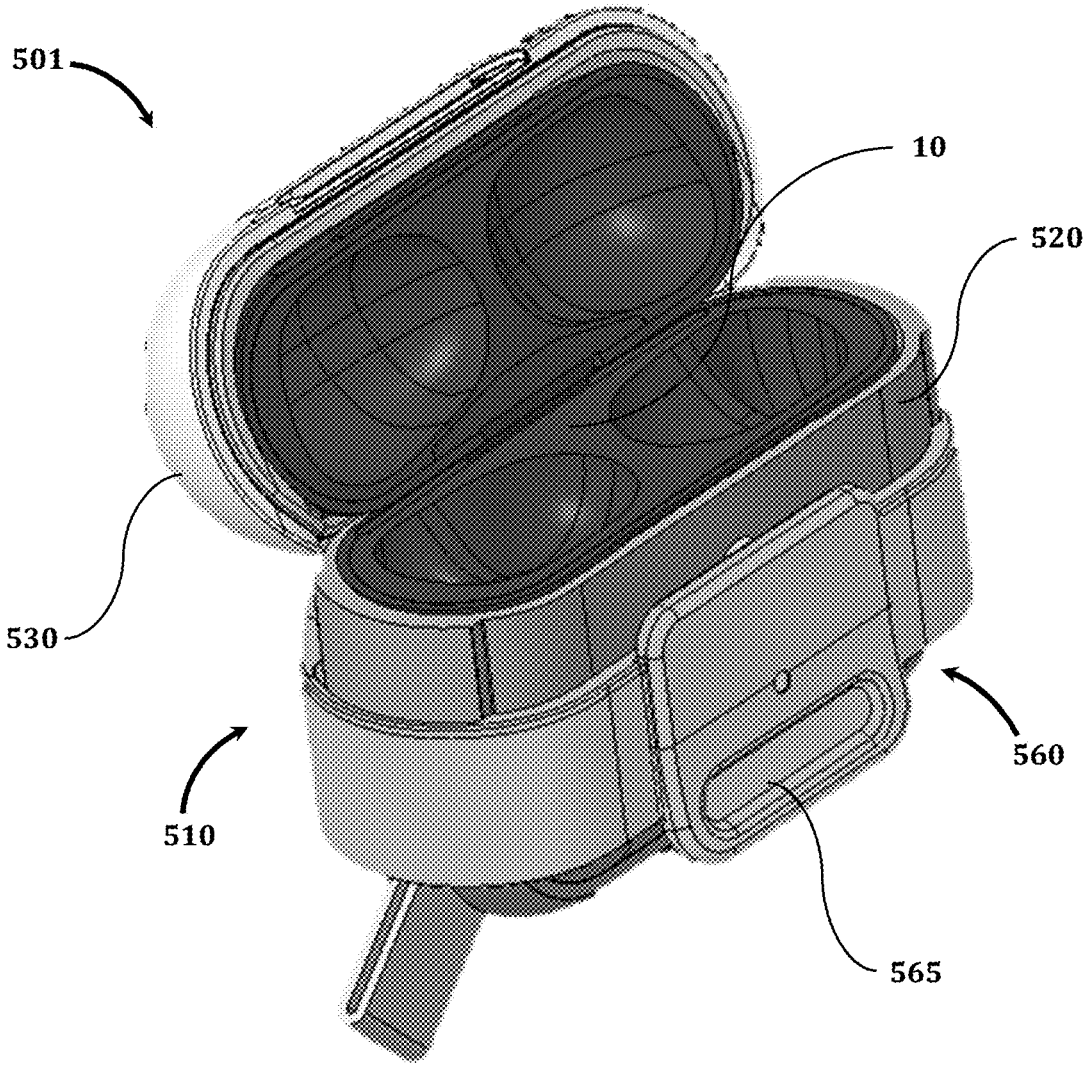
FIG. 26 is a top perspective view of an earbud device storage system, shown in an open state in accordance with an embodiment.
Figure 27A:
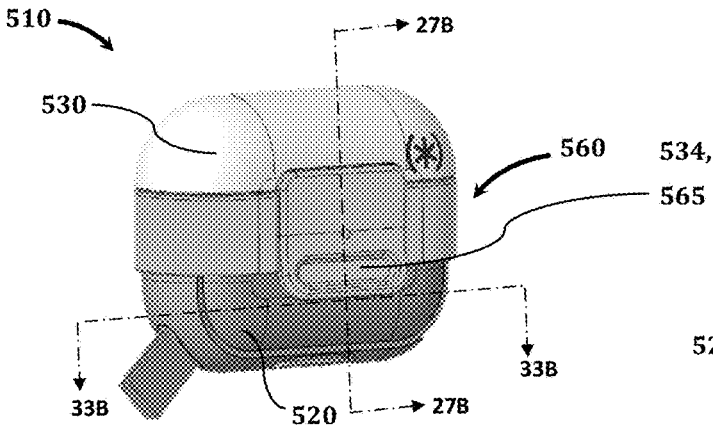
FIG. 27A is a left front perspective view of an outer case in accordance with an embodiment, shown in a closed state.
Figure 27B:
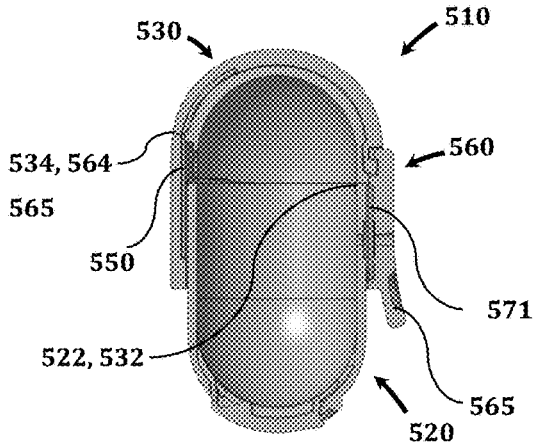
FIG. 27B is a left front cross-sectional view of the outer case of FIG. 27A, taken along lines 27B-27B.

Referring now to FIGS. 26, 27A, and 27B, earbud device storage system 501 includes charging case 10 and outer case 510 into which the charging case is seated. In the example shown, storage system 501 forms part of an audio device system that includes earbuds (not shown), e.g., Airpods® wireless earphones by Apple, Inc. With reference to FIGS. 26-27D, outer case 510 includes base 520 and lid 530 in which lid 530 rotates with a lid of charging case 10 from a closed position to an open position, as in the example shown in FIG. 26, to allow access to earbuds that may be inserted into the charging case for charging and storage. In the closed position of outer case 510 (see FIG. 27A), lid 530 fully covers an opening of base 520 for receiving charging case 10 and the lid is further secured to collar 560 to thereby secure the charging case and its contents within the outer case. In this manner, charging case 10 is protected from dust such that outer case 510 may have an IP5X rating according to IEC 60529 (also EN 60529). In satisfying this standard, dust that enters outer case 510 during testing does not enter charging case 10. Lid 530 is opened by depressing and pushing or pulling collar lever 565 of collar 560 in a direction away from lid 530 to release a latched connection (see FIG. 32) between the collar and the lid and simultaneously cause the collar to pull on the lid and thereby cause the lid to pivot away from base 520 and expose charging case 10 for access to the case and its contents. In terms of storing a charging case such as charging case 10, outer case 510 operates in a substantially similar manner to outer case 520 described above.

Referring now to FIGS. 27A-27E, outer case 510 further includes flexible panel 550, collar 560 slidably attached to base 520 and attached to lid 530 by the flexible panel, port cover 580, and attachment member 590. Lid 530 includes lid inner layer 531 and lid outer layer 533 attached to the lid inner layer, e.g., via co-molding, co-casting, or an adhesive as known to those skilled in the art. Lid inner layer 531 may be a flexible layer as described further herein and have lid inner layer rim 532 and lid outer layer 533 may be a rigid layer as described further herein and have lid outer layer rim 534. Lid inner layer 531 defines an interior of the lid and lid outer layer 533 defines an exterior of the lid in which the lid inner layer extends beyond lid outer layer rim 534 such that lid inner layer rim 532 is spaced from the lid outer layer rim.

Figure 28A:
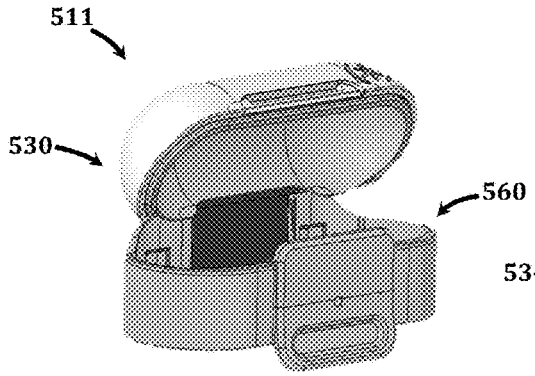
FIG. 28A is a left front perspective view of an upper subassembly of the outer case of FIG. 27A, shown in the open state.
Figure 28B:
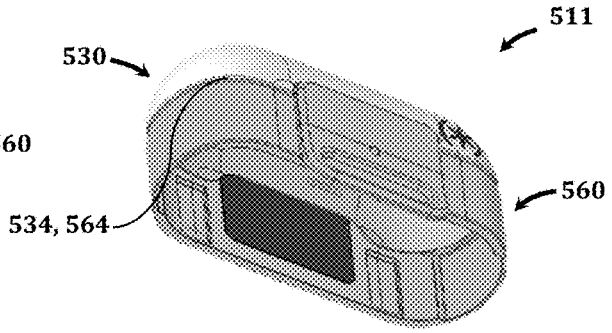
FIG. 28B is a left bottom perspective view of the upper subassembly of FIG. 28A, shown in the closed state.
Figure 28C:
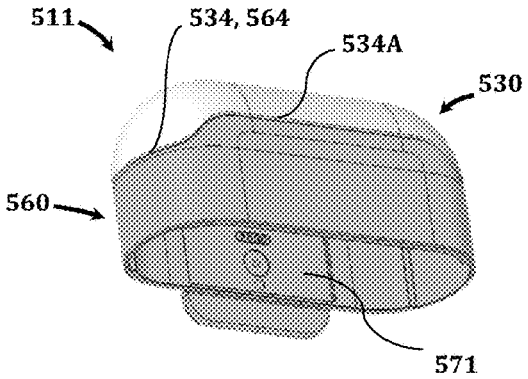
FIG. 28C is a right rear perspective view of the upper subassembly of FIG. 28A, shown in the closed state.
Figure 29:
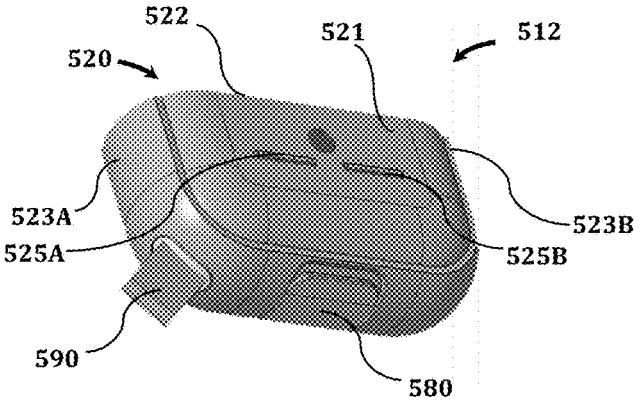
FIG. 29 is a left bottom perspective view of a lower subassembly of the outer case of FIG. 27A.
Figure 30:
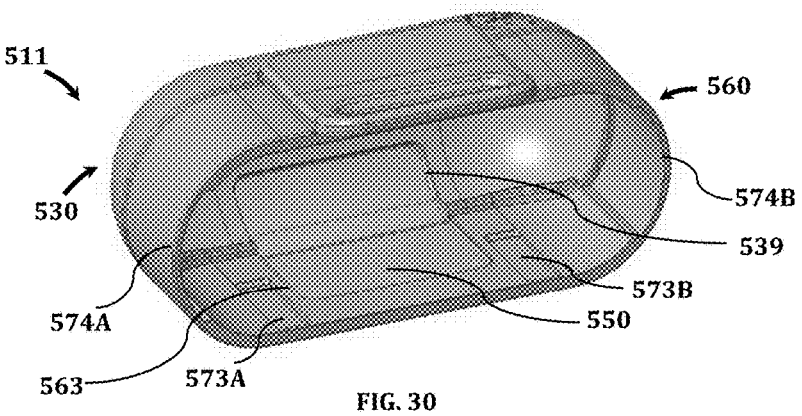
FIG. 30 is a left bottom perspective view of the upper subassembly of FIG. 28A.

As shown in FIGS. 28A-29, outer case 510 may be divided into upper subassembly 511 and lower subassembly 512. Upper subassembly 511 includes lid 530, collar 560, and flexible panel 550 that attaches the lid to the collar such that the lid is pivotable away from the collar, as demonstrated by the contrast between FIG. 28A and FIGS. 28B, 28C. The components of upper subassembly 511 may be assembled and held together without attachment to lower subassembly 512. As shown in FIG. 30, flexible panel 550 may be fitted within and extend between lid panel recess 539 of lid 530 and collar panel recess 563 of collar 560 such that the flexible panel may be flush with or, as in the example of FIG. 30, rest below top edges of the lid panel and collar panel recesses.

Figure 31A:
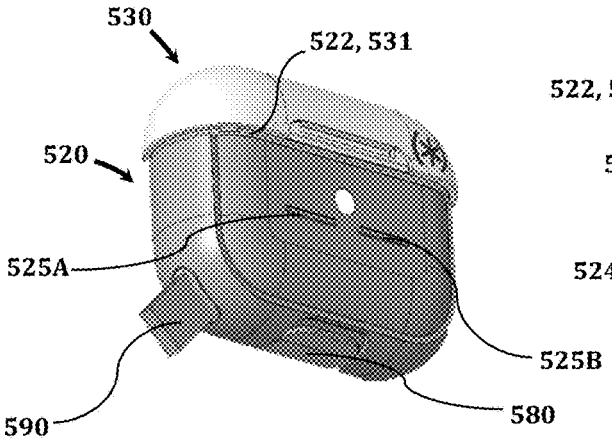
FIG. 31A is a left front perspective view of the outer case of FIG. 27A without a collar.
Figure 31B:
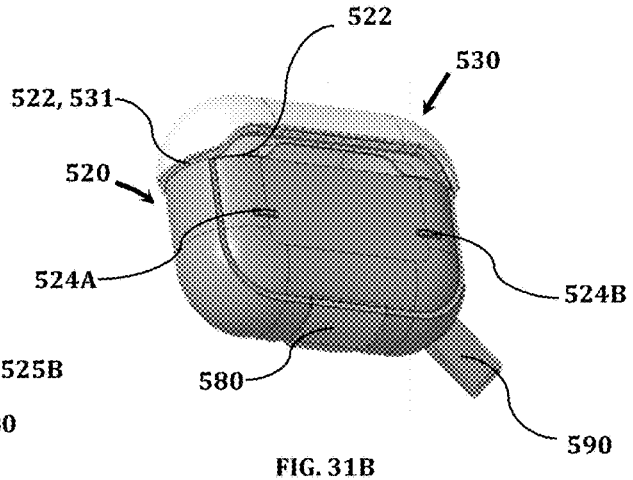
FIG. 31B is a right rear perspective view of the outer case of FIG. 27A without a collar.

Referring again to FIG. 29 and further referring now to FIGS. 31A and 31B, lower subassembly 512 includes base 520, port cover 580, and attachment member 590 which may be assembled and held together without attachment to upper subassembly 511. As shown, base 520 includes base main body 521 having base rim 522, base side flanges 523A, 523B extending from left and right sides of the base main body, base rear flanges 524A, 524B extending from a rear side of the base main body, and base front flanges 525A, 525B, the flanges being described further below. As shown by FIGS. 527B, 531A, 531B, and 532, when outer case 510 is in the closed position, lid inner layer rim 532 is in abutment with base rim 522 along front sides, i.e., sides opposite flexible panel 550, and at least respective left and right sides adjacent to the front sides of lid inner layer 531 and base 520. In this manner, dust and other particles, e.g., lint, may be prevented from entering outer case 510 when the outer case is in the closed position.

Referring now to FIGS. 27E and 29-31B in view of FIGS. 27A-27D, collar 560 includes circumferential band 562 configured to wrap around base 520 and collar latch portion 561 attached to the circumferential band. In some arrangements, as in the example shown, an interior surface of circumferential band 562 may be dimensioned such that all or at least a portion of the circumferential band is in contact with all or a substantial portion of a circumference of an exterior surface of base 520 during opening of lid 530 via sliding of collar 560 along base 520. As shown by FIGS. 27B, 27C, 28B, 28C, and 32, collar 560 has collar upper rim 564 that is in abutment with lid outer layer rim 534 when outer case 510 is in the closed position. In this manner, dust and other particles may be further prevented from entering outer case 510 when the outer case is in the closed position. Collar 560 further includes front track recess 571 and rear track recesses 573A, 573B on a side of the collar opposite the front track recesses as well as left and right track recesses 574A, 574B between the front and respective ones of the rear track recesses. In this manner, when upper subassembly 511 is properly assembled to lower subassembly 512, base front flanges 525A, 525B are received within front track recess 571, base rear flanges 524A, 524B are received within respective rear track recesses 573A, 573B, and base side flanges 523A, 524B are received within respective left and right track recesses 574A, 574B such that the collar is slidable along base 520 toward and away from lid 530.

Figure 27C:
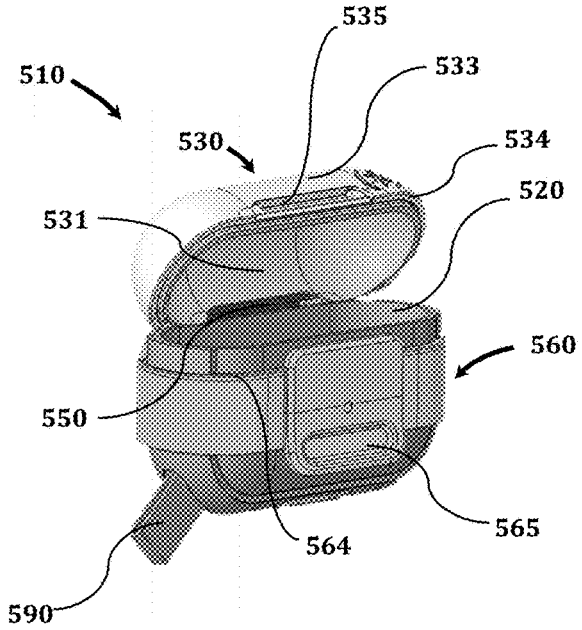
FIG. 27C is a left front perspective view of the outer case of FIG. 27A, shown in an open state.
Figure 27D:
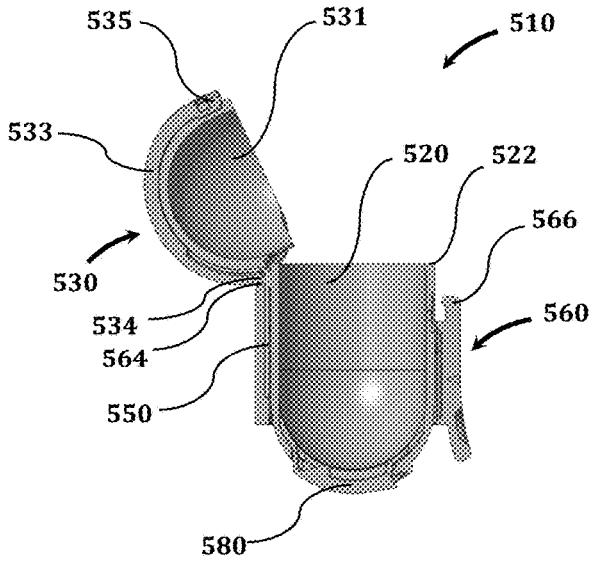
FIG. 27D is a left front cross-sectional view of the outer case of FIG. 27A, shown in the open state.

Referring now to FIGS. 27C, 27D, 28A-28C, and 32, lid outer layer 533 of lid 530 includes lid catch 535 defining lid catch recess 536 and having lid catch taper 537 on an end of the lid catch. Collar latch portion 561 of collar 560 includes a collar latch body protruding from circumferential band 562 on a front of outer case 510. Collar hook 566 extends from one end of the collar latch body 561A and defines collar hook recess 567 configured for receipt into lid catch recess 536 while collar lever 565 extends from another end of the collar latch body opposite from the collar hook. Collar lever 565 is spaced from base 520 such that the collar lever may be depressed inwardly towards the base to rotate collar hook 566 away from lid catch 535. Upon sufficient rotation of collar hook 566 away from lid catch 535 and simultaneously receipt of a downward force, such as a push or pull in a direction towards a bottom of base 520 and thus a bottom of outer case 510, applied to collar latch portion 561, lid 530 is released from being held in position by the collar latch portion. Sufficient downward force applied to collar latch portion 561 or to any other portion of collar 560 while the lid is released pulls flexible panel 550 in a direction towards the bottom of base 520 and thereby pulls a rear portion of lid 530 opposite lid catch 535 in the same direction resulting in rotation of lid 530 about an axis defined by a most rearward portion 534A of lid outer layer rim 534 shown in FIG. 28C. In this manner, in some arrangements, when collar 560 is pulled or pushed downwardly, flexible panel 550 is sufficiently elastic such that the flexible panel stretches sufficiently to create clearance by way of a small gap between lid outer layer rim 534 and collar upper rim 564 and thus to allow rearward portion 534A of lid outer layer rim 534 to rotate inwardly toward base 520 during rotation of lid 530 relative to the base. Rearward portion 534A is slightly raised relative to the rest of lid outer layer rim 534 and top ends of track recesses 571, 573A, 573B of collar 560 each provide respective lips acting as stops for their respective flanges 24A, 24B, 25A, 25B of base 520 such that lid 530 is rotated to a fully open state when the flanges contact the top ends of the recesses. Rearward portion 534A further creates clearance such that rearward portion 534A of lid outer layer rim 534 rests below base rim 522 and below a rear portion of collar upper rim 564 upon full rotation of lid 530 relative to the base without interference from either the base (see FIGS. 27C and 27D showing the lid and the base in the middle of a rotation of the lid) or from collar 560 (see FIGS. 27C and 28A showing the lid and the collar in the middle of a rotation of the lid). In the example shown, collar 560 may be slid downwardly such that collar upper rim 564 is below lid outer layer rim 534 initially at full rotation of lid 530, as shown in FIG. 27D, but upon release of the collar, the elasticity of flexible panel 550 may be sufficient to pull the collar upwardly such that the rear portion of the collar upper rim is above rearward portion 534A of outer lay rim 534. The generally raised configuration of rearward portion 534A thus allows lid 530 to open more fully than if the rearward portion was not raised relative to the rest of lid outer layer rim 534 and further provides for clearance for flexible panel 550 when the lid is rotated open fully. When lid 530 is rotated open fully, rearward portion 534A of lid outer layer rim 534 is aligned in a vertical direction generally near but below base rim 522 such that lid outer layer rim 534 abuts a rearward side of base 520 in this open state.

Figure 32:
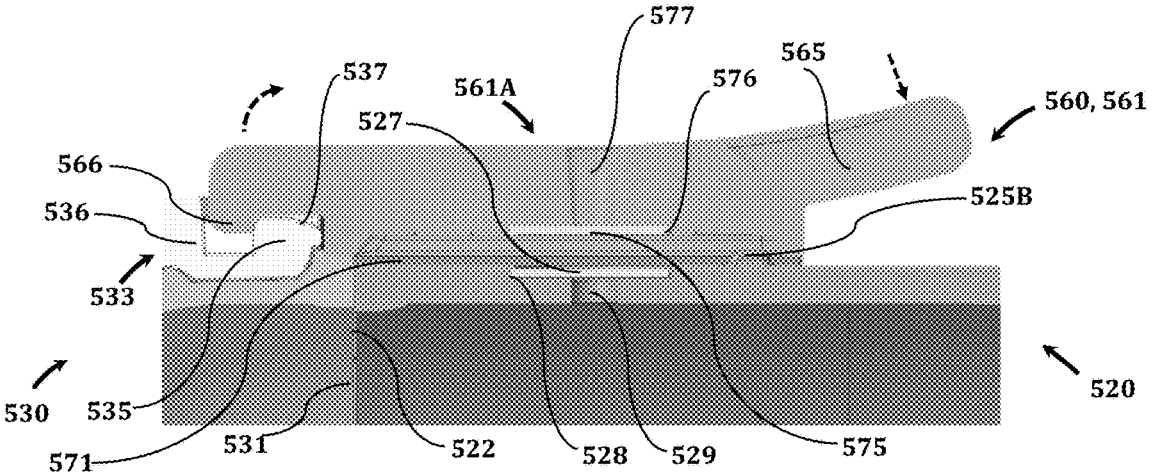
FIG. 32 is an enlarged view of a front portion of the cross-section of the outer case shown in FIG. 27B.

As further shown in FIG. 32, base lens 527 is inserted into base 520 and collar lens 575 is inserted into collar 560. Base 520 further includes base lens cavity 528 and base lens aperture 529 extending through a thickness of base 520 and similarly collar 560 further includes collar lens cavity 576 and collar lens aperture 577 extending through a thickness of collar 560 at collar latch portion 561. Base lens aperture 529 and collar lens aperture 577 are configured and aligned such that light emitted by charging case 10, e.g., a light-emitting diode (LED) indicating power or charging, is visible to the naked eye by a user of earbud device storage system 501 when outer case 510 is in a closed position. Base lens 527 is inserted, e.g., by an interference fit, an adhesive, or both, into base lens cavity 528 forming a counterbore of base lens aperture 529 and similarly collar lens 575 is inserted into collar lens cavity 576 forming a counterbore of collar lens aperture 577. Base lens 527 and collar lens 575, which preferably may be in the form of a film, prevent intrusion of dust and other particles while allowing light to pass through both base 520 and collar 560 when lid 530 of outer cover 510 is in the closed position.

Figure 27E:
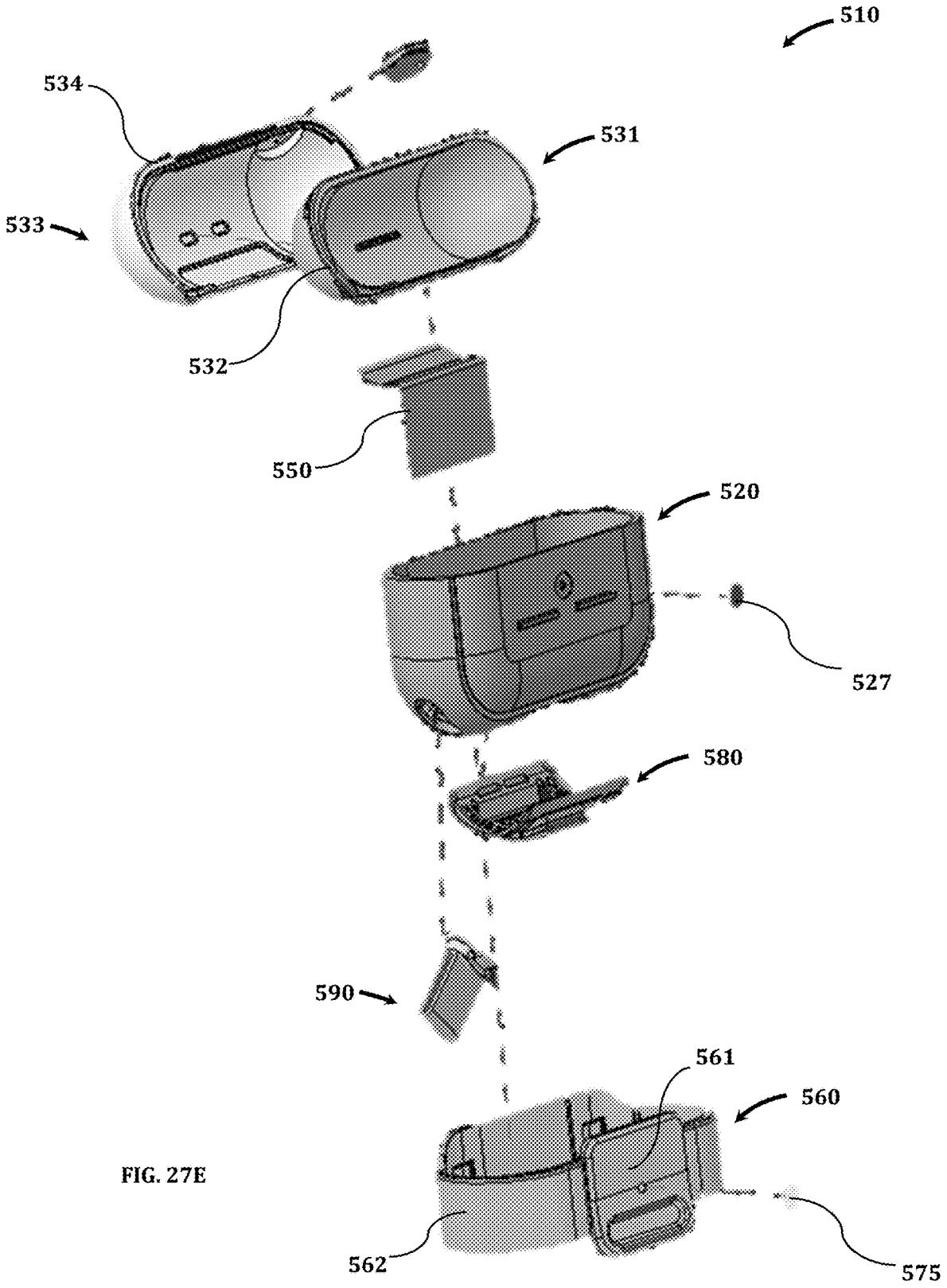
FIG. 27E is an exploded view of the outer case of FIG. 27A.
Figure 33A:
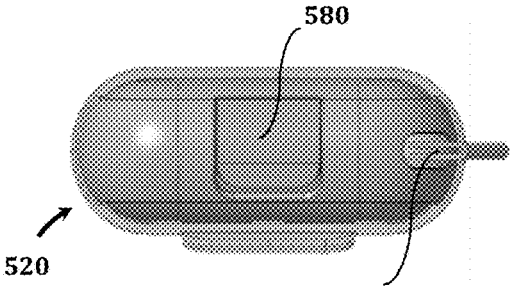
FIG. 33A is a bottom view of the outer case of FIG. 27A.
Figure 33B:
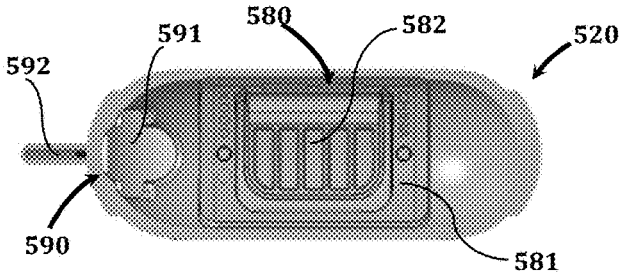
FIG. 33B is a top cross-sectional view of the outer case of FIG. 27A taken along lines 33B-33B.

Referring now to FIGS. 27E, 33A, and 33B, port cover 580 of outer case 510 extends through the thickness of base 520 at a bottom of the base to allow access into the outer case, e.g., to allow a charging plug to be inserted into charging case 10 through the port cover. Port cover 580 includes cover base 581 affixed to an interior of base 520 and port cover door 582 attached along one side of the cover base such that the port cover door is rotatable from a position covering a hole through the bottom of base 520 to a position outside of the base to allow exposure of and access to charging case 10.

Still referring to FIGS. 27E, 33A, and 33B, outer case 510 further includes attachment member 590 inserted through the thickness of a bottom corner of base 520. Attachment member 590 includes loop base 591 affixed to the interior of base 520 and attachment loop 592 attached to or integral with the loop base. Attachment loop 592 is configured for attachment to a carabiner or other similar attachment object and may be but is not limited to being made of a flexible textile such that when the attachment loop is attached to such attachment object, the attachment loop may be stretched in a direction away from the attachment object to allow for easier access to outer case 510 and thereby charging case 10 or other components of earbud device storage system 501 when the charging case is inserted into the outer case.

Lid inner layer 531, port cover 580, and attachment member 590 preferably may be made of elastomeric or other suitably flexible materials. Preferred materials include thermosetting plastics with a hard durometer having shore 30D to shore 100D, polycarbonate, poly(methyl methacrylate) ("PMMA"), metals, acrylonitrile butadiene styrene ("ABS"), PMMA, polyethylene terephthalate ("PET"), high durometer thermoplastic elastomers ("TPEs") and thermoplastic polyurethanes ("TPUs") having shore 30D to shore 100D, and any combination thereof. In some arrangements, lid inner layer 531, port cover 580, and attachment member 590 may be made of a non-Newtonian dilatant material, as further described in U.S. Patent Application Publication Nos. 2019/0075899 A1 and 2019/0075900 A1. Lid inner layer 531, port cover 580, and attachment member 590 may be made of the same material or a different material than either one or both of the other of the lid inner layer, the port cover, and the attachment member.

Base 520 and lid outer layer 533 preferably may be made of a rigid or hard material to create a rigid/hard shell which provides at least some impact protection as well as protection from being punctured by impacts with sharp objects. Preferred hard/rigid materials include hardened plastic material, a rigid or semi-rigid plastic material, a rigid/hard rubber material, a polycarbonate material, a metal, an alloy, a para-aramid material, wood, glass, mirror, quartz, and any combination thereof, and may be any color or texture. Such materials may be the same as or may mimic the material or materials used for charging case 10. Base 520 and lid outer layer 533 preferably are made of the same material, although these layers may be made of different materials.

Any one or any combination of surfaces of base 520, lid inner layer 531, lid outer layer 533, collar 560, port cover 580, and attachment member 590 exposed to users in either one or both of the open and closed positions of outer case 520 may be treated with an antimicrobial material applied as a coating or any one of such components 520, 531, 533, 560, 580, and 590 may have an antimicrobial material embedded into such layers. Preferred antimicrobial materials include silver or silver alloy (e.g., silver sodium hydrogen zirconium phosphate), copper or copper alloy, organosilanes, quaternary ammonium compounds (e.g., dimethyloctadecyl (3-trimethoxysilyl propyl) ammonium chloride, alkyldimethylbenzylammonium chloride, and didecyldimethylammonium chloride), chlorhexidine, chlorhexidine incorporated hydroxyapatite materials, chlorhexidine-containing polymers (e.g., chlorhexidine-containing polylactide), and antibiotics (e.g., gentamicin, cephalothin, carbenicillin, amoxicillin, cefamandol, tobramycin, vancomycin). Preferred antimicrobial coatings include coatings containing any of the aforementioned antimicrobial materials, chlorhexidine-containing polylactide coatings on an anodized surface, and polymer and calcium phosphate coatings with chlorhexidine. These antimicrobial treatments aid in reducing the presence and preventing the growth of microbes (e.g., bacteria, fungi, viruses, etc.), thereby aiding in preventing the spread of related sicknesses, illnesses, or diseases.

It should be understood that covers for other audio device systems, such as but not limited to microphones, voice recorders, and the like, that may or may not be encased in or accompanied by a charging case or charging dock, as well as other handheld electronic device systems, such as but not limited to remote controllers, pagers, video game wands or other controllers, and the like, that may or may not be encased in or accompanied by a charging case or charging dock, are encompassed by the present disclosure.

It is noted that the terminology used above is for the purpose of reference only and is not intended to be limiting. For example, terms such as "upper," "lower," "above," "below," "rightward," "leftward," "clockwise," and "counterclockwise" refer to directions in the drawings to which reference is made. As another example, terms such as "inward" and "outward" may refer to directions toward and away from, respectively, the geometric center of the component described. As a further example, terms such as "front," "rear," "side," "left side," "right side," "top," "bottom," "horizontal," and "vertical" describe the orientation of portions of the component within a consistent but arbitrary frame of reference which is made clear by reference to the text and the associated drawings describing the component under discussion. Such terminology will include the words specifically mentioned above, derivatives thereof, and words of similar import.

While this invention has been described in conjunction with the specific embodiments outlined above, it is evident that many alternatives, modifications, and variations will be apparent to those skilled in the art. Indeed, the disclosure set forth herein includes all possible combinations of the particular features set forth above, whether specifically disclosed herein or not. For example, where a particular feature is disclosed in the context of a particular aspect, arrangement, configuration, or embodiment, that feature can also be used, to the extent possible, in combination with and/or in the context of other particular aspects, arrangements, configurations, and embodiments of the invention, and in the invention generally. Moreover, the disclosure set forth herein includes the mirror image, i.e., mirror configuration, taken from any perspective of any drawing or other configuration shown or described herein. Accordingly, the preferred embodiments of the invention as set forth above are intended to be illustrative, not limiting. Various changes may be made without departing from the spirit and scope of the inventions as defined in the following claims.

In addition, it is noted that citation or identification of any document in this application is not an admission that such document is available as prior art to the present invention.

The invention claimed is:

1. An outer case for covering a handheld electronic device or handheld electronic device case, the outer case comprising:

a base;

a lid pivotably attached to the base; and a collar slidable along the base and away from the lid such that the lid rotates away from the base as the collar slides away from the lid.

2. The outer case of claim 1, wherein the rotation of the lid away from the base is approximately proportional to the movement of the collar away from the lid.

3. The outer case of claim 2, wherein the rotation of the lid away from the base is approximately linearly proportional to the movement of the collar away from the lid.

4. The outer case of claim 1, the outer case further comprising a flexible panel, wherein the lid is attached to the collar via the flexible panel.

5. The outer case of claim 4, wherein the lid is rotatable away from the base about a pivot axis, and wherein the collar has a collar upper rim that remains below an interface between the lid and the base during rotation of the lid away from the base.

6. The outer case of claim 4, wherein the collar includes a first side attached to the flexible panel and a second side attached to the first side, the second side being configured for selectively securing a side of the lid to a side of the base such that the outer case is in a closed position.

7. The outer case of claim 6, wherein the collar is slidable along the base such that the flexible panel slides with the collar during movement of the collar away from the lid.

8. The outer case of claim 7, wherein at least a portion of the collar surrounds an exterior of the base.

9. The outer case of claim 6, wherein the second side of the collar is latched to the lid in the closed position of the outer case.

10. The outer case of claim 6, wherein the second side of the collar is opposite the first side of the collar.

11. The outer case of claim 1, wherein at least a portion of the collar is slidable along the base.

12. The outer case of claim 1, wherein the base or the collar includes one or more flanges and the other of the base and the collar includes one or more recessed tracks, and wherein the one or more flanges protrude into and are slidable along respective ones of the one or more tracks.

13. The outer case of claim 1, wherein the base includes an interior defining a base opening, and wherein the lid covers the base opening.

14. The outer case of claim 1, wherein the lid has a first lid rim along at least a first portion of the lid and the collar has a collar upper rim, and wherein the lid rotates away from the base from a closed position of the outer case in which the first lid rim is in abutment with the collar upper rim to an open position of the outer case in which the first lid rim is spaced from the collar upper rim.

15. The outer case of claim 14, wherein the base has a base rim defining a top of the base, wherein the first lid rim defines a bottom of the lid, and wherein the first lid rim is recessed such that the first lid rim extends below the base rim and the lid covers a covered portion of the collar in the open position of the outer case.

16. The outer case of claim 14, wherein the base is made of a rigid plastic material and the lid includes a lid inner layer made of a flexible plastic material and a lid outer layer made of a rigid plastic material.

17. The outer case of claim 16, wherein the base has a base rim, wherein the lid outer layer includes the first lid rim and the lid inner layer includes a second lid rim, and wherein the second lid rim is in abutment with the base rim when the outer case is in the closed position.

18. The outer case of claim 17, wherein the lid inner layer extends beyond the lid outer layer such that the lid inner layer overlaps a portion of the collar when the outer case is in the closed position.

19. The outer case of claim 14, wherein a lid exterior surface of the lid and a collar exterior surface of the collar are coextensive such that the lid and the collar exterior surfaces are flush when the outer case is in the closed position.

20. The outer case of claim 1, further comprising a textile attachment loop extending through the base.

21. The outer case of claim 1, wherein the base defines a base hole extending through a thickness thereof, the outer case further comprising a port cover, the port cover including a cover base attached to the base and a port cover door attached to the cover base such that the port cover door is rotatable from a position covering the base hole to a position exposing the base hole for insertion of components through the base hole.

22. A handheld electronic device system comprising:

either one or both of a handheld electronic device and a handheld electronic device case configured for storing the electronic device; and the outer case of claim 1 enclosing the one or both of the electronic device and the electronic device case in a first state and exposing the one or both of the electronic device and the electronic device case in a second state.

23. An outer case for covering a handheld electronic device or handheld electronic device case, the outer case comprising:

a base;

a lid; and a collar attached to the base and the lid such that the lid is pivotable about a pivot axis relative to the base, wherein the collar is moveable in a direction away from the lid such that the lid rotates away from the base during movement of the collar in the direction away from the lid.

24. The outer case of claim 23, further comprising an elastic panel, the collar being attached to the lid via the elastic panel.

* * * * *